US010415927B1

(12) United States Patent
Shults et al.

(10) Patent No.: US 10,415,927 B1
(45) Date of Patent: Sep. 17, 2019

(54) AMBIDEXTROUS HOLSTER CONVERTIBLE BETWEEN AN IWB USE CONFIGURATION AND AN OWB USE CONFIGURATION

(71) Applicant: Vista Outdoor Operations LLC, Anoka, MN (US)

(72) Inventors: Brian Shults, Boise, ID (US); Robert Kincaid, Manhattan, MT (US); Liam Yarbrough, Nampa, ID (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 15/955,380

(22) Filed: Apr. 17, 2018

Related U.S. Application Data

(60) Provisional application No. 62/486,156, filed on Apr. 17, 2017, provisional application No. 62/533,510, filed on Jul. 17, 2017.

(51) Int. Cl.
*F41C 33/02* (2006.01)
*F41C 33/04* (2006.01)

(52) U.S. Cl.
CPC ..... *F41C 33/043* (2013.01); *F41C 33/0209* (2013.01); *F41C 33/045* (2013.01); *F41C 33/048* (2013.01); *A45F 2200/0591* (2013.01); *F41C 33/041* (2013.01)

(58) Field of Classification Search
CPC .... F41C 33/041; F41C 33/043; F41C 33/048; Y10S 224/911; Y10S 224/912; A45F 2200/0591
See application file for complete search history.

(56) References Cited

U.S. PATENT DOCUMENTS

| | | | | |
|---|---|---|---|---|
| 2,349,376 A | | 5/1944 | Ray | |
| 2,551,913 A | | 5/1951 | Toby | |
| 3,250,448 A | | 5/1966 | Clark | |
| 3,589,574 A | * | 6/1971 | Marburger | F41C 33/041 224/672 |
| 3,731,858 A | * | 5/1973 | Baker | F41C 33/0227 224/192 |
| 3,910,469 A | | 10/1975 | Baldocchi | |

(Continued)

FOREIGN PATENT DOCUMENTS

| | | |
|---|---|---|
| EP | 2757271 A2 | 7/2014 |
| WO | WO2013071402 | 5/2013 |

(Continued)

*Primary Examiner* — Justin M Larson
(74) *Attorney, Agent, or Firm* — Christensen, Fonder, Dardi & Herbert PLLC

(57) ABSTRACT

A holster comprising a body portion, the body portion comprising a port shell and a starboard shell that cooperate to define a cavity for receiving and holding the handgun. The holster comprising a pair of flat ears, the ears including a forward ear extending forward of the cavity and a rearward ear extending rearward of the cavity. The forward ear defining a forward slot and the rearward ear defining a rearward slot, each slot having a forward edge and a rearward edge. Each slot being configured and dimensioned to receive one of a belt and a clip. Each ear having changes in thickness adjacent the forward and rearward edges of each slot. The changes in thickness defining multiple discrete positions for receiving a holster body attachment portion of the clip.

20 Claims, 23 Drawing Sheets

(56) References Cited

U.S. PATENT DOCUMENTS 3,915,361 A 10/1975 Perkins
D240,225 S * 6/1976 Baker ..... D3/222
4,318,503 A 3/1982 Capano
4,398,655 A 8/1983 Perry
4,544,089 A * 10/1985 Tabler ..... F41C 33/0236 224/192
4,759,482 A * 7/1988 Olsen ..... F41C 33/0227 224/238
5,054,671 A * 10/1991 Else ..... F41C 33/0209 224/192
5,100,036 A 3/1992 Rogers et al.
D335,221 S * 5/1993 Nichols ..... D3/222
5,282,559 A 2/1994 Wisser et al.
5,419,474 A 5/1995 Marx et al.
5,518,155 A 5/1996 Gallagher
5,533,657 A * 7/1996 Rosen ..... A45F 5/02 224/191
5,570,830 A 11/1996 Nichols
5,573,157 A 11/1996 Mauriello et al.
5,630,535 A 5/1997 Valenti
D392,458 S 3/1998 Batts
5,810,221 A 9/1998 Beletsky et al.
5,855,305 A 1/1999 Nichols
5,865,357 A 2/1999 Goodwin
5,918,784 A 7/1999 Serpa
5,944,239 A 8/1999 Rogers et al.
6,085,951 A 7/2000 Beletsky et al.
6,112,962 A 9/2000 Matthews
6,283,351 B1 * 9/2001 Brite ..... F41C 33/0227 224/238
6,575,343 B2 6/2003 Mossman
6,588,639 B2 7/2003 Beletsky et al.
6,604,657 B2 * 8/2003 Yirmiyahu ..... F41C 33/0227 224/243
6,616,020 B1 9/2003 Spielberger
6,732,891 B2 5/2004 Locklear, III
6,752,300 B2 6/2004 Har-Shen
6,755,331 B2 6/2004 Rassias
6,769,582 B1 8/2004 Beletsky et al.
D501,991 S 2/2005 Cook et al.
6,854,626 B2 2/2005 Liao
7,204,395 B2 4/2007 Gallagher
7,314,152 B1 1/2008 Garrett
7,461,765 B2 12/2008 French et al.
7,556,181 B2 7/2009 Spielberger
7,841,497 B1 11/2010 Gregory et al.
7,866,515 B1 * 1/2011 Buis, III ..... F41C 33/02 224/197
D653,848 S * 2/2012 Alstrom ..... D3/222
8,141,758 B2 3/2012 Spielberger
RE44,428 E 8/2013 Spielberger
8,672,201 B2 3/2014 Craighead
D702,935 S 4/2014 Rogers et al.
8,720,755 B2 * 5/2014 Gregory ..... F41C 33/0263 224/244
D733,422 S 7/2015 Rogers et al.
9,086,254 B1 7/2015 Plappert
9,144,292 B2 9/2015 Prestwich
D740,021 S 10/2015 Faifer
9,267,760 B2 * 2/2016 Slinkard ..... F41C 33/043
D773,806 S 12/2016 Laemmlen
9,523,555 B2 12/2016 Pellegrini
D776,918 S 1/2017 Madrid
D776,919 S 1/2017 Tate
D784,008 S 4/2017 Rogers et al.
D792,088 S 7/2017 Laemmlen
D798,585 S 10/2017 Laemmlen
D801,041 S 10/2017 Lance et al.
D802,914 S 11/2017 Sereday et al.
D806,382 S * 1/2018 Beard ..... D3/222
9,933,234 B1 * 4/2018 Shows ..... F41A 35/02
9,958,233 B2 * 5/2018 Considine ..... F41C 33/048
D831,338 S * 10/2018 Laemmlen ..... D3/222
D835,398 S * 12/2018 Wilson ..... D3/222
D840,147 S * 2/2019 Shults ..... D3/222
2001/0048009 A1 12/2001 Vor Keller et al.
2002/0017541 A1 2/2002 French
2002/0134803 A1 9/2002 Lowe et al.
2002/0153396 A1 10/2002 French et al.
2004/0050887 A1 3/2004 Spielberger
2004/0188477 A1 * 9/2004 Parsons ..... A45F 5/02 224/251
2005/0035163 A1 2/2005 French et al.
2005/0205621 A1 9/2005 Shults
2005/0205624 A1 9/2005 French et al.
2005/0279788 A1 12/2005 Lowe et al.
2007/0181619 A1 8/2007 Seyfert et al.
2013/0181021 A1 7/2013 Yarbrough et al.
2014/0027486 A1 * 1/2014 McGee ..... F41C 33/02 224/587
2014/0158733 A1 * 6/2014 McDonnell ..... B60R 7/14 224/587
2015/0115005 A1 4/2015 Slinkard
2015/0267994 A1 * 9/2015 Tedder ..... A45F 5/00 224/242
2016/0102940 A1 * 4/2016 Sykes ..... F41C 33/0236 224/587
2016/0216065 A1 * 7/2016 Tedder ..... F41C 33/0263
2016/0273878 A1 9/2016 Sereday et al.
2016/0370144 A1 * 12/2016 Laemmlen ..... A45F 5/02
2017/0227324 A1 * 8/2017 Metayer ..... F41C 33/0209
2018/0010885 A1 * 1/2018 Tedder ..... F41C 33/0209
2018/0142990 A1 * 5/2018 Tedder ..... F41C 33/041

FOREIGN PATENT DOCUMENTS

WO WO2014028876 2/2014
WO WO2017165547 9/2017

* cited by examiner

FIG. 11D
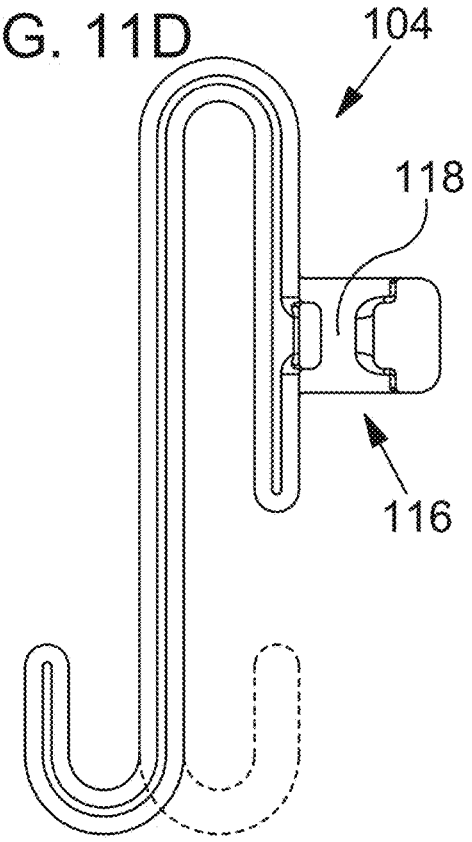
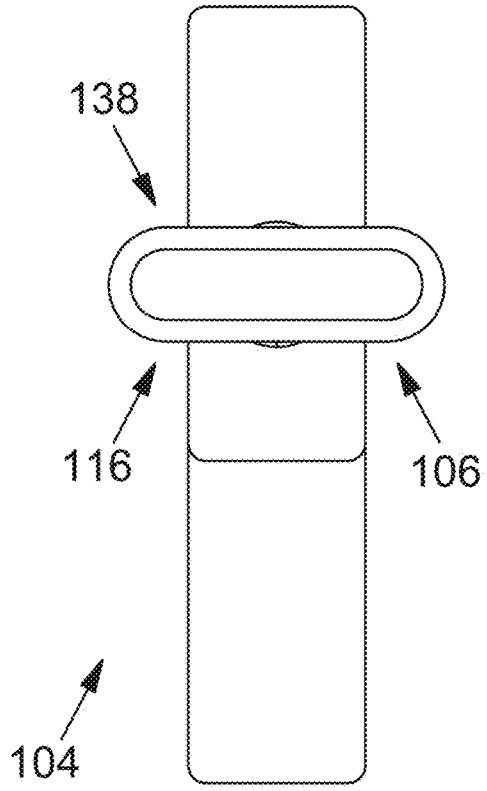
FIG. 11E
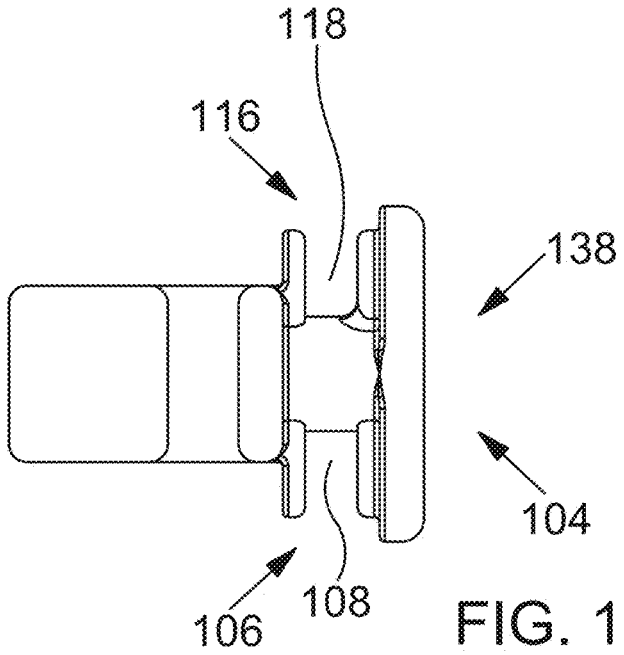
FIG. 11F

-X
y
z
-x
154
150
124
152
134
126
120
130
128
122
132
144
142
140
112
110
114
128
190
180
182
164
162
148
176
192
140
172
174
158

AMBIDEXTROUS HOLSTER CONVERTIBLE BETWEEN AN IWB USE CONFIGURATION AND AN OWB USE CONFIGURATION

CROSS-REFERENCE TO RELATED APPLICATION

This application claims the benefit of U.S. Provisional Application No. 62/486,156 filed Apr. 17, 2017, and U.S. Provisional Application No. 62/533,510, filed Jul. 17, 2017, the disclosures of which are incorporated by reference herein.

BACKGROUND OF THE DISCLOSURE

In the United States and other countries, many law enforcement officers carry a firearm in an openly visible manner while on duty. These same law enforcement officers often carry a firearm in a concealed manner when not on duty. The Law Enforcement Officers Safety Act (LEOSA) is a United States federal statute that permits qualified law enforcement officers to carry a concealed firearm in any jurisdiction in the United States, regardless of state or local laws, with certain exceptions. It would be desirable to provide a single holster configured for both openly carrying a firearm and carrying a firearm in a concealed manner. To accomplish this dual use, it would be desirable to provide a single holster configured to be used both inside and outside the user's pants. Approximately twelve percent of the world's population are left handed. Accordingly, it would be desirable to provide a single holster configured for use by both left-handed and right-handed law enforcement officers.

SUMMARY

A holster designed for use in multiple holster applications is provided. The holster may be used with one or more clips, the one or more clips mechanically interlocking with the holster in various positions without the use of fasteners such as screws. The holster may also be used by both right-handed and left handed users. The holster can be positioned both inside of the user's waistband and outside of the user's waistband. A belt can be inserted through slots defined by flange portions of the holster when the holster is positioned outside of the waist band. The one or more clips can be removed from the holster while the holster is being used with a belt.

The holster can be worn in four different configurations as shown in FIGS. 1A-1D. FIG. 1A is a perspective view showing a holster disposed inside the waistband of a pair of pants. In the example embodiment of FIG. 1A, the holster is located proximate a right rear pocket of the pants for convenient use by a right handed user. FIG. 1B is a perspective view showing a holster disposed inside the waistband of a pair of pants. In the example embodiment of FIG. 1B, the holster is located proximate a left rear pocket of the pants for convenient use by a left handed user. FIG. 1C is a perspective view showing a holster disposed outside the waistband of a pair of pants. In the example embodiment of FIG. 1C, the holster is located proximate a right rear pocket of the pants for convenient use by a right handed user. FIG. 1D is a perspective view showing a holster disposed outside the waistband of a pair of pants. In the example embodiment of FIG. 1D, the holster is located proximate a left rear pocket of the pants for convenient use by a left handed user. A belt is illustrated using dashed lines in FIG. 1C and FIG. 1D. The belt may extend through slots defined by the holster.

The holster comprises a body portion having an upper end and a lower end, the body portion comprising a port shell and a starboard shell that cooperate to define a cavity for receiving and holding a handgun. The upper end of the body defines an upper opening of the cavity. The cavity extends in a downward direction from the upper opening to the lower end of the body portion and extends in an upward direction from the lower end of the body portion to the upper opening. A forward end of the port shell meets a forward end of the starboard shell at a central plane and a rearward end of the port shell meets a rearward end of the starboard shell at the central plane. In embodiments, the cavity has a shape that is substantially a mirror image about the central plane so that the holster can be used by both left-handed users and right-handed users. In embodiments, the central plane extends in a forward direction from the rearward end of the port shell to the forward end of the port shell and extends in a rearward direction from the forward end of the port shell to the rearward end of the port shell. In embodiments, the central plane also extends in the upward and downward directions.

A feature and benefit of embodiments is a holster assembly including a plurality of clips that can be quickly attached to a holster and detached from the holster. The clips may be attached to the holster to convert the holster from an outside the waistband (OWB) mode of operation to an inside the waistband (IWB) mode of operation. The clips may be detached from the holster to convert the holster from the inside the waistband (IWB) mode of operation to the outside the waistband (OWB) mode of operation.

A feature and benefit of embodiments is a holster assembly including a plurality of clips that can be quickly repositioned on a holster. Repositioning the clips allows the cant or angle of the holster to be changed to accommodate the personal preferences of different users. Repositioning the clips allows the height of the holster relative to the user's waistband to be changed.

A feature and benefit of embodiments is a holster that is configured to allow use in multiple holster applications. The holster can be secured either inside of the user's waistband or outside of the user's waistband. The holster is also configured to be used by both right-handed and left-handed users. Inside the waistband and outside the waistband may be referred to using the acronyms IWB and OWB, respectively. In embodiments the holster may be used in four applications: IWB right-handed, IWB left-handed, OWB right-handed, and OWB left-handed.

A feature and benefit of embodiments is a holster including slot portions adapted and configured to interface with both clips and belts. A belt can be inserted through slots defined by flange portions of the holster, for example, when the holster is positioned outside of the waist band. In embodiments, the holster includes groups of protrusions located along frontward and rearward edges of the slots. The protrusions are equally spaced along the respective edge with spaces between adjacent pairs of protrusions being dimensioned to receive a part of an interlocking portion of a clip while a flap of the holster is extending into a gap defined by the interlocking portion of the clip.

A feature and benefit of embodiments is a holster assembly including one or more clips secured to a holster without the use of threaded fasteners such as screws. In these embodiments, the possibility that threaded fasteners will come loose is eliminated. The possibility that the threads of a fastener will become stripped is also eliminated in these embodiments.

A feature and benefit of embodiments is a holster assembly including one or more clips secured to a holster without the use of fasteners of any kind. In these embodiments, the possibility that small fastener components will be lost or misplaced is eliminated.

A feature and benefit of embodiments is a holster assembly including one or more clips secured to a holster in way that allows the position of the clips to be adjusted without the use of any tools. This feature and benefit allows a user to configure the holster assembly to fit his or her body and clothing and preferred holster configuration while away from home and office.

A feature and benefit of embodiments is a holster configuration that is supported by a belt and/or waistband at two points, the two points being separated from one another by a span distance. This configuration makes it more likely that the angle of the holster relative to the user will remain constant even during movements of the user (e.g., walking, running, and jumping).

In embodiments, the holster comprises a forward flange and a rearward flange. The forward flange has a rearward end abutting the forward ends of the shells. The forward flange extends in the forward direction beyond the forward ends of the shells. The forward flange has a starboard facing surface and an opposite portward facing surface. The forward flange defines at least one forward slot extending between the starboard facing surface and the portward facing surface. The rearward flange has a forward end abutting the rearward ends of the shells. The rearward flange extends in the rearward direction beyond the rearward ends of the shells. The rearward flange has a starboard facing surface and an opposite portward facing surface. The rearward flange defines at least one rearward slot extending between the starboard facing surface and the portward facing surface. In embodiments, the forward flange defined an additional slot. In embodiments, each slot has forward edge and a rearward edge.

In embodiments, the holster comprises a plurality of strategically placed port protrusions and starboard protrusions. The port protrusions are disposed on the portward facing surface of each flange and each port protrusion extends in a portward direction beyond the corresponding portward facing surface. In embodiments, the portward direction is generally orthogonal to the central plane of the holster. In embodiments, the starboard protrusions are disposed on the starboard facing surface of each flange and each starboard protrusion extends in a starboard direction beyond the corresponding starboard facing surface. In embodiments, the starboard direction is generally orthogonal to the central plane of the holster.

In embodiments, a first group of port protrusions is arranged on the portward facing surface of the forward flange along the forward edge of the forward slot and a second group of port protrusions is arranged on the portward facing surface of the forward flange along the rearward edge of the forward slot. In embodiments, a third group of starboard protrusions is arranged on the starboard facing surface of the forward flange along the forward edge of the forward slot and a fourth group of starboard protrusions is arranged on the starboard facing surface of the forward flange along the rearward edge of the forward slot. In embodiments, the protrusions in the first group, the second group, the third group and the fourth group are equally spaced along the respective edge with spaces between adjacent pairs of protrusions being dimensioned to receive a part of an interlocking portion of a clip while a part of the forward flange is extending into a gap defined by the interlocking portion of the clip. Each clip comprises a first interlocking portion defining a first gap and a second interlocking portion defining a second gap.

In embodiments, a first group of port protrusions is arranged on the portward facing surface of the forward flange along the forward edge of the rearward slot and a second group of port protrusions is arranged on the portward facing surface of the forward flange along the rearward edge of the rearward slot. In embodiments, a third group of starboard protrusions is arranged on the starboard facing surface of the forward flange along the forward edge of the rearward slot and a fourth group of starboard protrusions is arranged on the starboard facing surface of the forward flange along the rearward edge of the rearward slot. In embodiments, the protrusions in the first group, the second group, the third group and the fourth group are equally spaced along the respective edge with spaces between adjacent pairs of protrusions being dimensioned to receive a part of an interlocking portion of a clip while a part of the forward flange is extending into a gap defined by the interlocking portion of the clip. Each clip comprises a first interlocking portion defining a first gap and a second interlocking portion defining a second gap.

In embodiments, a first group of port protrusions is arranged on the portward facing surface of the forward flange along the forward edge of the additional slot and a second group of port protrusions is arranged on the portward facing surface of the forward flange along the rearward edge of the additional slot. In embodiments, a third group of starboard protrusions is arranged on the starboard facing surface of the forward flange along the forward edge of the additional slot and a fourth group of starboard protrusions is arranged on the starboard facing surface of the forward flange along the rearward edge of the additional slot. In embodiments, the protrusions in the first group, the second group, the third group and the fourth group are equally spaced along the respective edge with spaces between adjacent pairs of protrusions being dimensioned to receive a part of an interlocking portion of a clip while a part of the forward flange is extending into a gap defined by the interlocking portion of the clip. Each clip comprises a first interlocking portion defining a first gap and a second interlocking portion defining a second gap.

In embodiments, a holster for wearing inside the waist band and outside the waist band comprises a body portion and a plurality of clips. The body portion may include a handgun receiving portion and a unitarily formed forward flange and opposing rearward flange. Each of the forward flange and the rearward flange may have a starboard side and a port side with respective starboard facing surfaces and port facing surfaces. In embodiments, each of the forward flange and the rearward flange has a slotted portion. In embodiments, one of the slotted portions defines two slots, and the other of the slotted portions defines one slot. Each of the slots may be sized for receiving a belt. In embodiments, each of the slots has a forward edge and a rearward edge. In embodiments, each of the slots has a spaced series of bumps and valleys formed on the starboard surface adjacent the respective forward edge and adjacent the respective rearward edge. In embodiments, each of the slots has a spaced series of bumps and valleys formed on the port surface adjacent the respective forward edge and adjacent the respective rearward edge.

In embodiments, a holster for wearing inside the waist band and outside the waist band comprises a body portion and a plurality of clips. In embodiments, each of the plurality of clips has a hook portion for attachment over a belt and/or waistband. In embodiments, the hook portion has a J-shape or an S-shape. In embodiments, each of the plurality of clips comprises a unitary flange attachment portion. In embodiments, the flange attachment portion of each of the clips has a T-shape with a shank portion defining the lower leg of the T-shape and the upper legs of the T-shape forming a first interlocking portion and a second interlocking portion. In embodiments, the shank portion of the T-shape extends away from hook portion and the interlocking portions oriented in an orientation direction cross-wise to an orientation direction of the hook portion. In embodiments, each of the slots are sized to receive the flange attachment portion, and upon receiving the flange attachment portion, each clip is rotatable to align the orientation direction of the hook portion with an orientation of the respective slot, wherein the first interlocking portion is seated between adjacent bumps on one of the spaced series of bumps and valleys and the second interlocking portion is seated between adjacent bumps on another of the spaced series of bumps and valleys.

In embodiments, a holster kit comprises a holster and a plurality of clips, each clip comprising a first interlocking portion defining a first gap and a second interlocking portion defining a second gap. The holster may comprise a body portion having a central portion defining a cavity dimensioned to receive a handgun. In embodiments, the body portion comprises a pair of flat ears, the ears including a forward ear extending forward of the cavity and a rearward ear extending rearward of the cavity. The forward ear may define a forward slot and the rearward ear may define a rearward slot. In embodiments, each slot has a forward edge and a rearward edge. In embodiments, each slot is configured and dimensioned to receive a belt and/or one or more of the clips. In embodiments, each ear has changes in thickness adjacent the forward edge and the rearward edge of each slot. In embodiments, the changes in thickness defining multiple discrete positions for receiving a first interlocking portion and a second interlocking portion of each clip.

In embodiments, a method of configuring a holster comprises providing a holster body portion having a handgun receiving portion and a unitarily formed forward flange and an opposing rearward flange. The method may include providing a first clip and a second clip, each clip having a T-shaped holster body attachment portion. The method may include inserting the T-shaped holster body attachment portion of the first clip into a selected one of a plurality of slots defined by the holster body portion. The method may include rotating the first clip so that the T-shaped holster body attachment portion secures the first clip to the holster at a first location along the selected slot. The method may include inserting the T-shaped holster body attachment portion of the second clip into another selected slot of the plurality of slots defined by the holster body portion. The method may include rotating the second clip so that the T-shaped holster body attachment portion secures the other selected clip to the holster at a first place along the other selected slot. The method may further comprise rotating the first clip to unsecure the T-shaped holster body attachment portion from the holster, moving the first clip to a second position along the selected slot, and rotating the first clip so that the T-shaped holster body attachment portion secures the first clip to the holster proximate the second position. The method may comprise rotating the second clip to unsecure the T-shaped holster body attachment portion from the holster, moving the second clip to a second place along the other selected slot xx, and rotating the second clip so that the T-shaped holster body attachment portion secures the second clip to the holster proximate the second place.

In embodiments, the holster includes a screw thread assembly including a screw and a nut. In embodiments, the screw extends through the handgun receiving portion below a trigger guard receiving portion for adjustably controlling the distance between opposing side wall portions of the body portion. In embodiments, the screw extends through the port shell and the starboard shell below a trigger guard receiving portion for adjustably controlling the distance between opposing side wall portions of the port shell and the starboard shell. In embodiments, one or both of the port shell and the starboard shell define a first slit and a second slit. In embodiments, the screw extends through the port shell and the starboard shell at a location between the first slit and the second slit. In embodiments, the first slit and the second slit define a leaf spring portion of the port shell and/or the starboard shell.

The above summary is not intended to describe each illustrated embodiment or every implementation of the present disclosure.

DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIG. 2 is a perspective view of a holster in accordance with the detailed description.

FIG. 11D is a rear view of the clip shown in FIG. 11A.

FIG. 11E is a left side view of the clip shown in FIG. 11A.

FIG. 11F is a bottom view of the clip shown in FIG. 11A. In the embodiment of FIG. 11, the clip has a shape similar to the shape of a letter S seen in a front view or a rear view. In FIGS. 11A and 11D, an alternate embodiment of a clip is illustrated using dashed lines. The clip illustrated using dashed lines has a shape similar to the shape of a letter C seen in a front view or a rear view.

FIG. 15A is a perspective view showing a holster disposed inside the waistband of a pair of pants. In the example embodiment of FIG. 15A, a belt is positioned to overlay a portion of each clip attached to the holster. The belt can be seen resting in a hook portion of each clip in FIG. 15A. In the example embodiment of FIG. 15A, the holster is located proximate a right rear pocket of the pants for convenient use by a right handed user.

FIG. 15B is a perspective view showing a holster disposed inside the waistband of a pair of pants. In the example embodiment of FIG. 15B, the holster is located proximate a left rear pocket of the pants for convenient use by a left handed user. In the example embodiment of FIG. 15B, a belt is positioned to overlay a portion of each clip attached to the holster. The belt can be seen resting in a hook portion of each clip in FIG. 15B.

FIG. 15C is a perspective view showing a holster and a belt extending through slots defined by the holster. In the example embodiment of FIG. 15C, the holster may be worn outside the waistband of a pair of pants with the holster located proximate a right rear pocket of the pants for convenient use by a right handed user.

FIG. 15D is a perspective view showing a holster and a belt extending through slots defined by the holster. In the example embodiment of FIG. 15D, the holster may be worn outside the waistband of a pair of pants with the holster located proximate a left rear pocket of the pants for convenient use by a left handed user.

FIGS. 17A through 17F may be collectively referred to as FIG. 17.

Figure 1A:
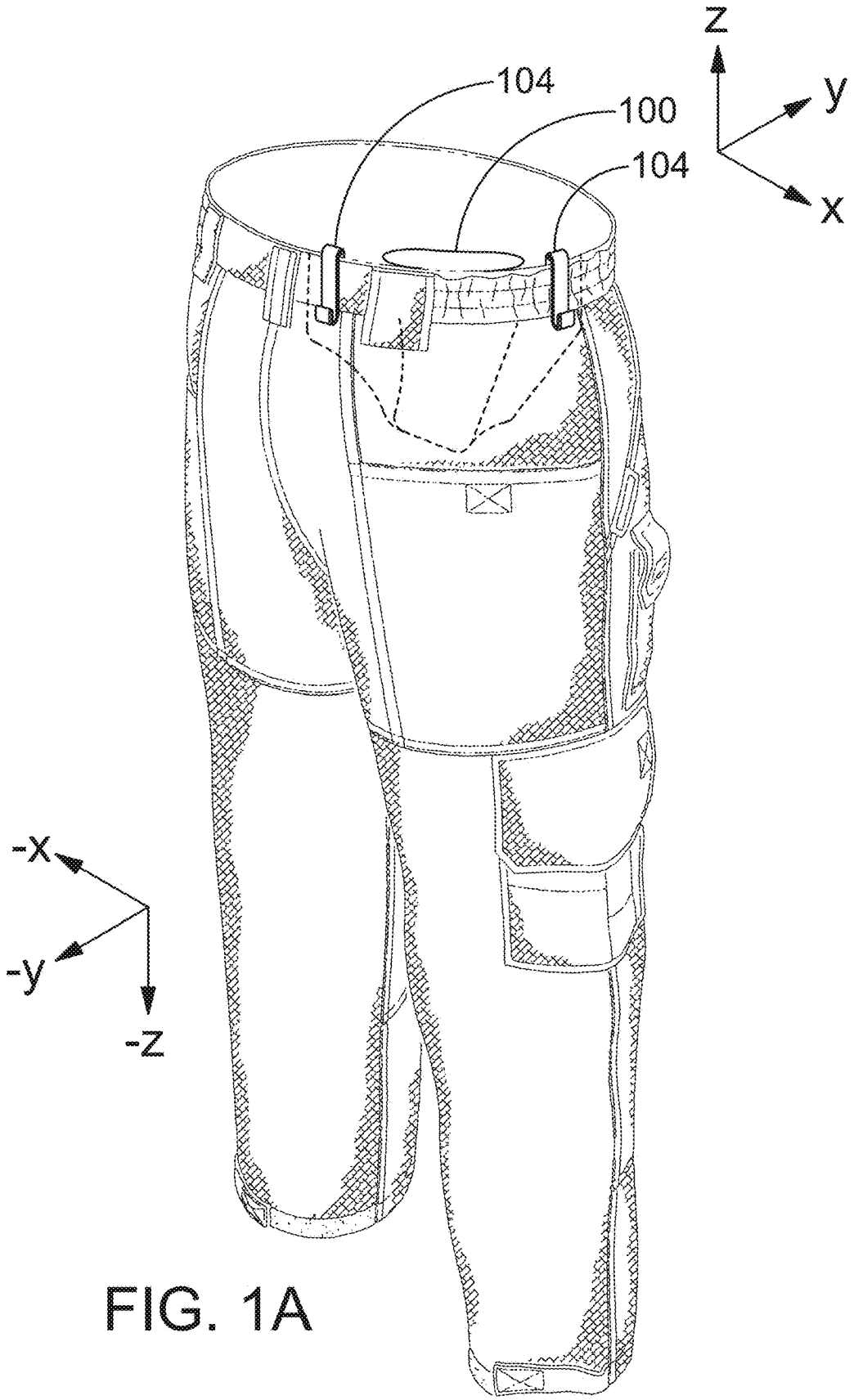
FIG. 1A is a perspective view showing a holster disposed inside the waistband of a pair of pants. In the example embodiment of FIG. 1A, the holster is located proximate a right rear pocket of the pants for convenient use by a right handed user. A belt may be positioned to overlay a portion of each clip attached to the holster. The belt may be received in a hook portion of each clip.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 1B:
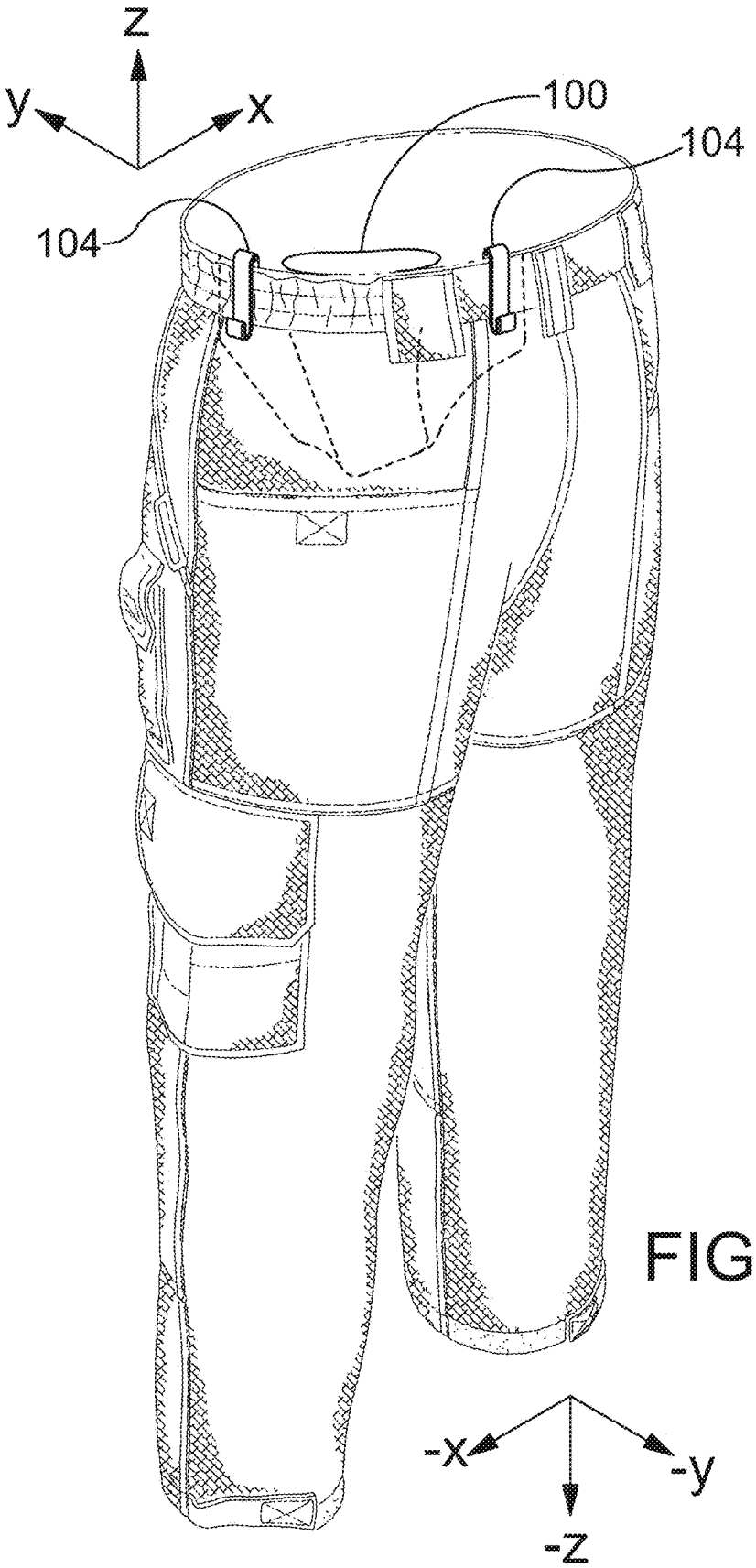
FIG. 1B is a perspective view showing a holster disposed inside the waistband of a pair of pants. In the example embodiment of FIG. 1B, the holster is located proximate a left rear pocket of the pants for convenient use by a left handed user. A belt may be positioned to overlay a portion of each clip attached to the holster. The belt may be received in a hook portion of each clip.
Figure 1C:
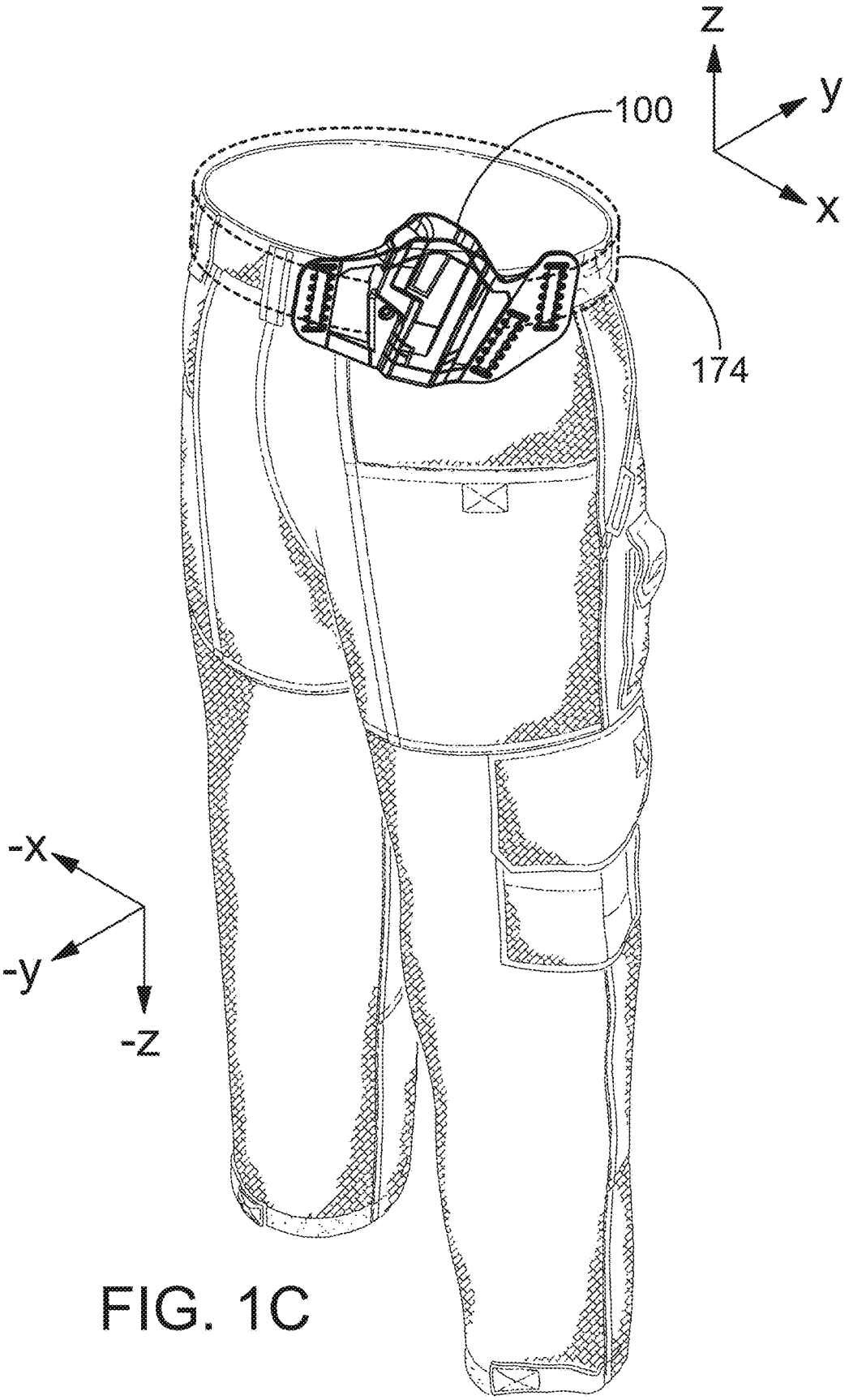
FIG. 1C is a perspective view showing a holster disposed outside the waistband of a pair of pants. In the example embodiment of FIG. 1C, the holster is located proximate a right rear pocket of the pants for convenient use by a right handed user.
Figure 1D:
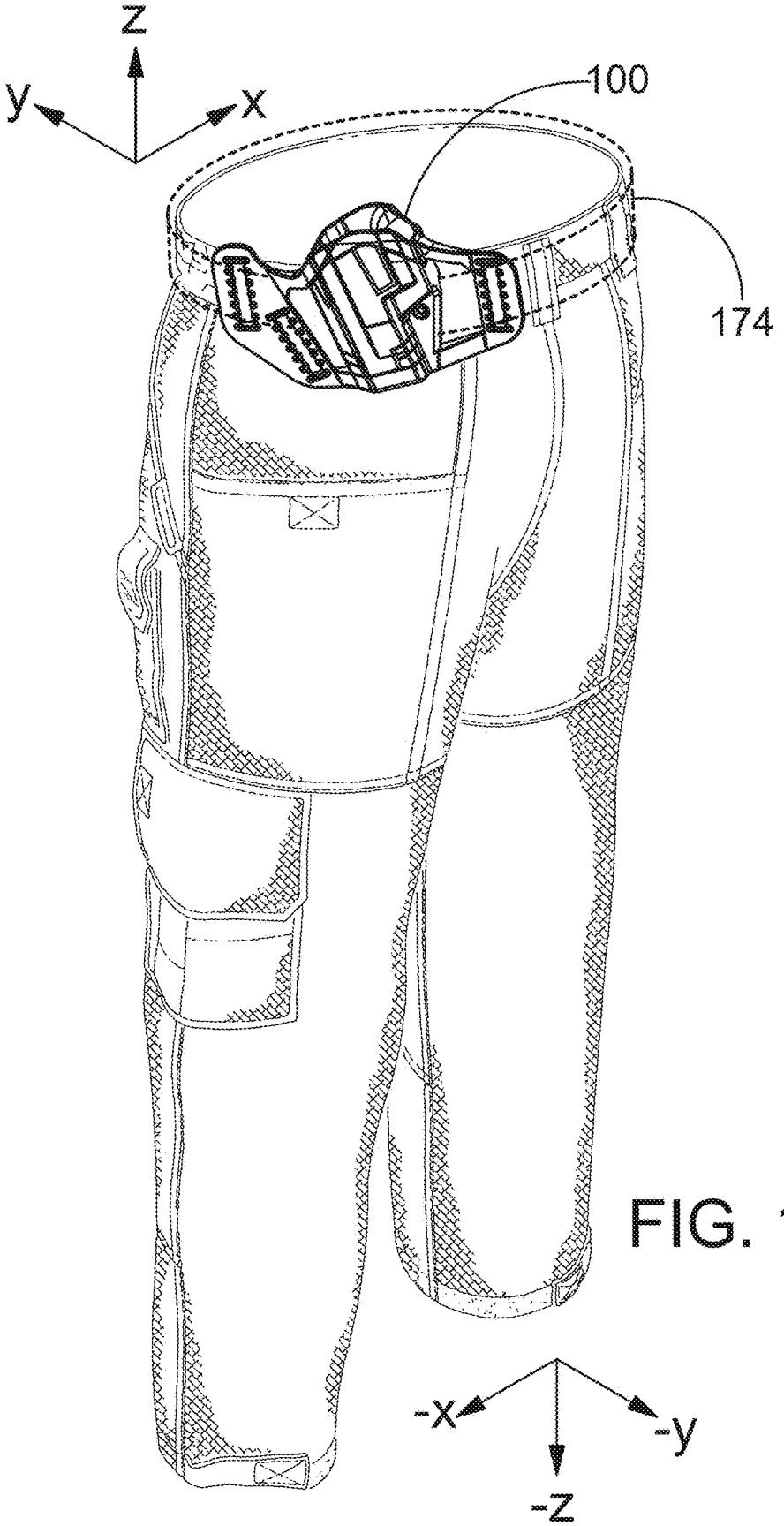
FIG. 1D is a perspective view showing a holster disposed outside the waistband of a pair of pants. In the example embodiment of FIG. 1D, the holster is located proximate a left rear pocket of the pants for convenient use by a left handed user. A belt is illustrated using dashed lines in FIG. 1C and FIG. 1D. The belt may extend through slots defined by the holster.
Figure 2:
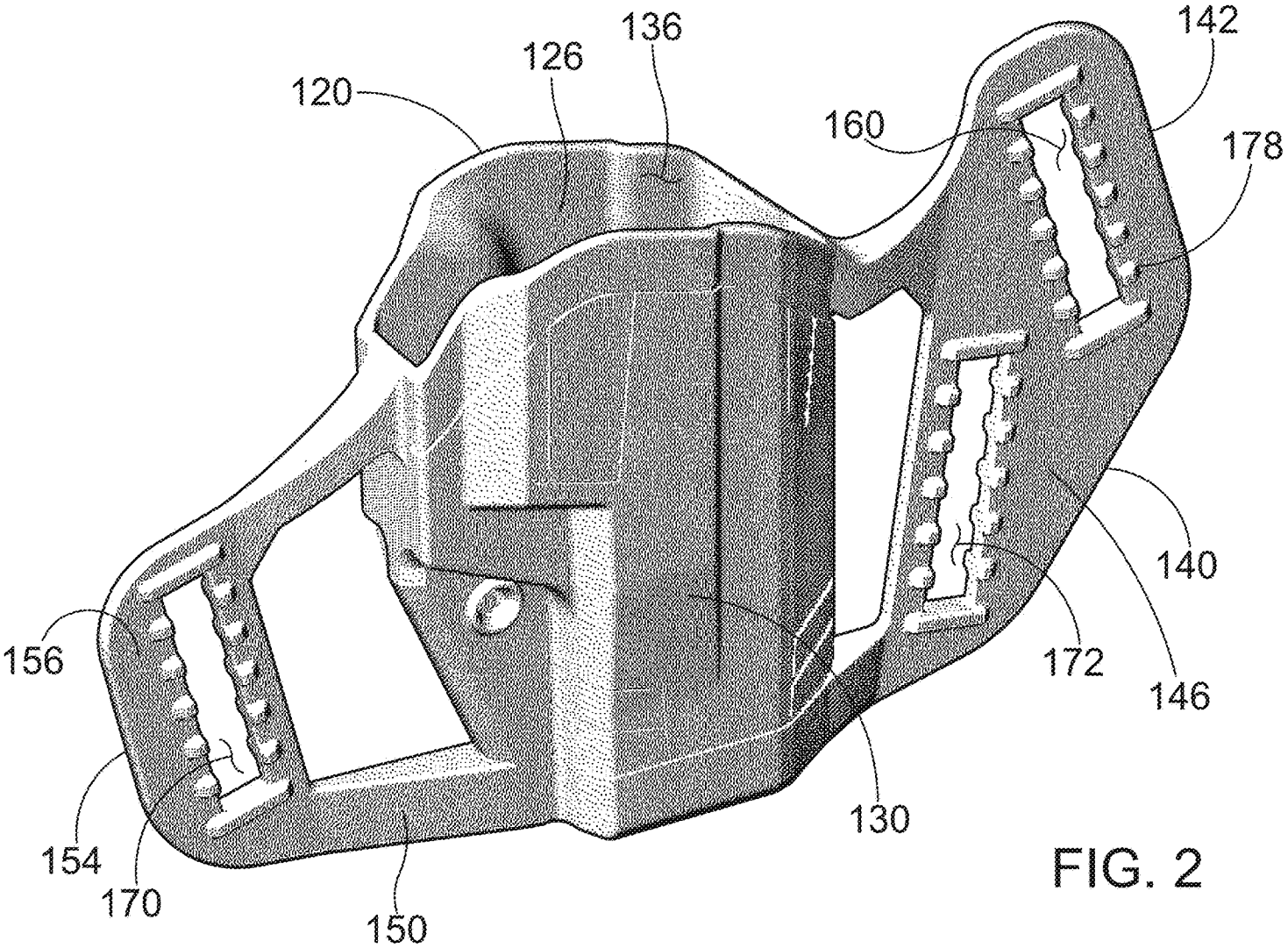
FIG. 2 is a perspective view of a holster in accordance with an embodiment described in the detailed description.
Figure 3:
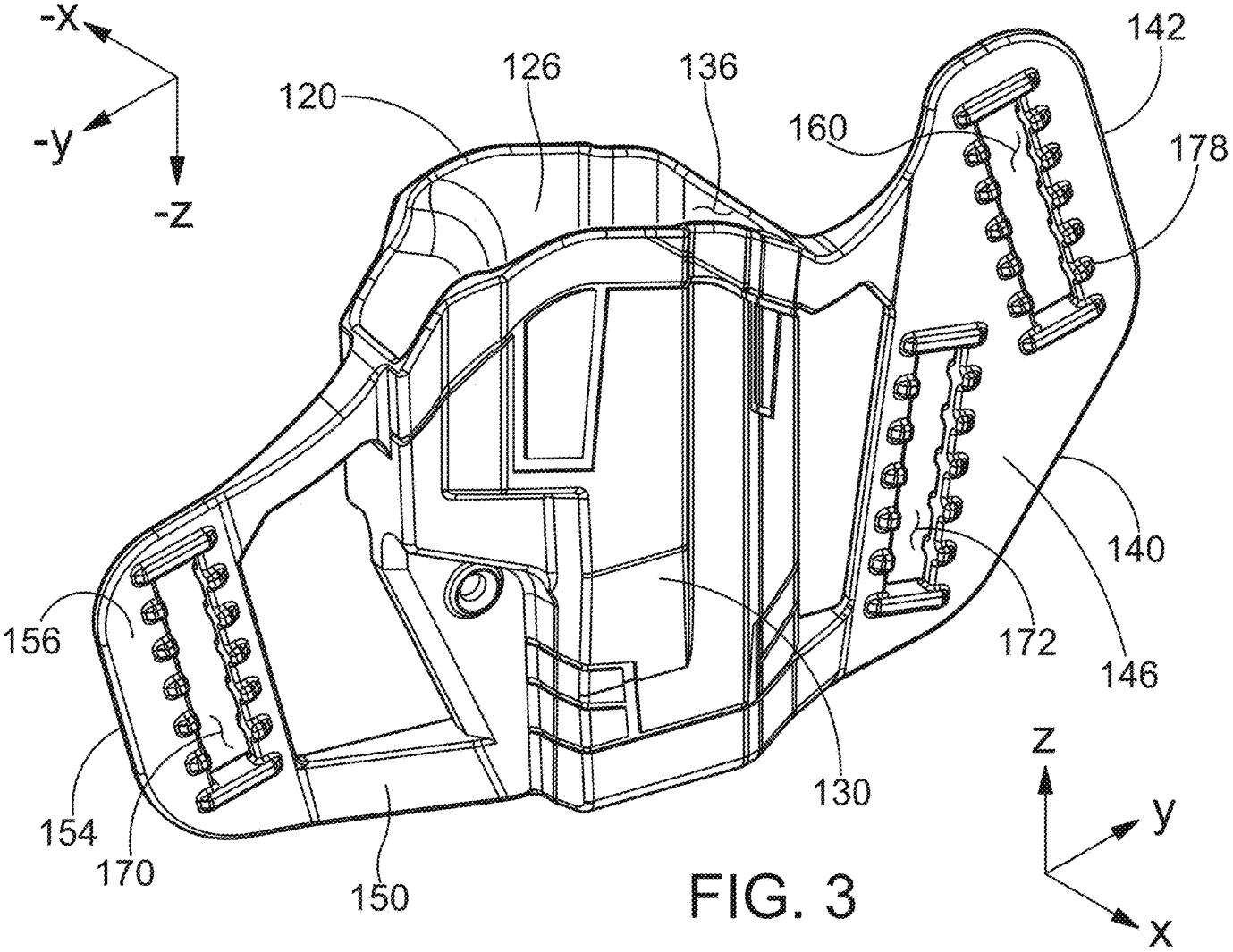
FIG. 3 is a perspective view of a holster in accordance with an embodiment described in the detailed description.

Referring FIGS. 1A-1D, an ambidextrous convertible holster 100 is shown being worn in four different use configurations. FIG. 1A is a perspective view showing the holster 100 disposed inside the waistband of a pair of pants. In the example embodiment of FIG. 1A, the holster 100 is located proximate a right rear pocket of the pants for convenient use by a right handed user. FIG. 1B is a perspective view showing the holster 100 disposed inside the waistband of a pair of pants. In the example embodiment of FIG. 1B, the holster 100 is located proximate a left rear pocket of the pants for convenient use by a left handed user. FIG. 1C is a perspective view showing the holster 100 disposed outside the waistband of a pair of pants. In the example embodiment of FIG. 1C, the holster 100 is located proximate a right rear pocket of the pants for convenient use by a right handed user. FIG. 1D is a perspective view showing the holster 100 disposed outside the waistband of a pair of pants. In the example embodiment of FIG. 1D, the holster 100 is located proximate a left rear pocket of the pants for convenient use by a left handed user. A belt 174 is illustrated using dashed lines in FIG. 1C and FIG. 1D. The belt 174 may extend through slots defined by the holster 100.

Referring to FIGS. 6-9, a holster 100 for receiving a handgun is capable of mechanically interlocking with one or more clips 104. The holster 100 comprises a body portion 110 having an upper end 112 and a lower end 114. The body portion 110 comprises a port shell 120 and a starboard shell 130 that cooperate to define a cavity 126 for receiving and holding the handgun 102. The upper end 112 of the body portion 110 defining an upper opening 136 of the cavity 126. The cavity 126 extends in a downward direction from the upper opening 136 to the lower end 114 of the body portion 110 and extends in an upward direction from the lower end 114 of the body portion 110 to the upper opening 136. The forward end 122 of the port shell 120 meets a forward end 132 of the starboard shell 130 at a central plane 128. A rearward end 124 of the port shell 120 meets a rearward end 134 of the starboard shell 130 at the central plane 128. In embodiments, the cavity 126 has a shape that is substantially a mirror image about the central plane 128 so that the holster can be used by both left-handed users and right-handed users. In embodiments, the central plane 128 extends in a forward direction from the rearward end 124 of the port shell 120 to the forward end 122 of the port shell 120 and extends in a rearward direction from the forward end 122 of the port shell 120 to the rearward end 124 of the port shell 120. In embodiments, the central plane 128 extends in the upward direction and the downward direction.

Referring to FIGS. 2-8, in embodiments, the holster 100 comprises a rearward flange 150 and a forward flange 140. The forward flange 140 has a rearward end 144 abutting the forward ends of the shells. The forward flange 140 extends in the forward direction beyond the forward ends of the shells. The forward flange 140 has a starboard facing surface 146 and a portward facing surface 148. In embodiments, the forward flange 140 defines at least one forward slot 160 extending between the starboard facing surface 146 and the portward facing surface 148. In embodiments, the rearward flange 150 has a forward end 152 abutting the rearward ends of the shells. The rearward flange 150 extends in the rearward direction beyond the rearward ends of the shells. The rearward flange 150 has a starboard facing surface 156 and a portward facing surface 158. In embodiments, the rearward flange 150 defines at least one rearward slot 170 extending between the starboard facing surface 156 and the portward facing surface 158. In embodiments, the rearward flange 150 has a shape that is substantially a mirror image about the central plane 128. In embodiments, the rearward flange 150 and the forward flange 140 each define a window. In embodiments, the forward flange 140 has a shape that is substantially a mirror image about the central plane 128.

Referring to FIGS. 2-8, in embodiments, the holster 100 comprises a plurality of port protrusions 176 and starboard protrusions 178. The port protrusions 176 are disposed on the portward facing surface 148 of the forward flange 140 and the portward facing surface 158 of the rearward flange 150. In embodiments, each port protrusion 176 extends in the portward direction beyond the corresponding portward facing surface, the portward direction being generally orthogonal to the central plane 128. In embodiments, the starboard protrusions 178 are disposed on the starboard facing surface 146 of the forward flange 140 and the starboard facing surface 156 of the rearward flange 150. In embodiments, each starboard protrusion 178 extends in a starboard direction beyond the corresponding starboard facing surface, the starboard direction being generally orthogonal to the central plane 128. In embodiments, the forward flange 140 defined an additional slot 172. In embodiments, each slot has forward edge 162 and a rearward edge 164.

Referring to FIGS. 2-8, in embodiments, a first group 180 of port protrusions 176 is arranged on the portward facing surface 148 of the forward flange 140 along the forward edge 162 of the forward slot 160 and a second group 182 of port protrusions 176 is arranged on the portward facing surface 148 of the forward flange 140 along the rearward edge 164 of the forward slot 160. In embodiments, a third group 184 of starboard protrusions 178 is arranged on the starboard facing surface 146 of the forward flange 140 along the forward edge 162 of the forward slot 160 and a fourth group 186 of starboard protrusions 178 is arranged on the starboard facing surface 146 of the forward flange 140 along the rearward edge 164 of the forward slot 160. In embodiments, the protrusions in the first group 180, the second group 182, the third group 184 and the fourth group 186 are equally spaced along the respective edge with spaces between adjacent pairs of protrusions being dimensioned to receive a part of an interlocking portion of a clip while a part of the forward flange 140 is extending into a gap defined by the interlocking portion of the clip. Each clip 104 comprises a first interlocking portion 106 defining a first gap 108 and a second interlocking portion 116 defining a second gap 118.

Referring to FIGS. 2-8, in embodiments, a first group 180 of port protrusions 176 is arranged on the portward facing surface 158 of the forward flange 140 along the forward edge 162 of the rearward slot 170 and a second group 182 of port protrusions 176 is arranged on the portward facing surface 158 of the forward flange 140 along the rearward edge 164 of the rearward slot 170. In embodiments, a third group 184 of starboard protrusions 178 is arranged on the starboard facing surface 156 of the forward flange 140 along the forward edge 162 of the rearward slot 170 and a fourth group 186 of starboard protrusions 178 is arranged on the starboard facing surface 156 of the forward flange 140 along the rearward edge 164 of the rearward slot 170. In embodiments, the protrusions in the first group 180, the second group 182, the third group 184 and the fourth group 186 are equally spaced along the respective edge with spaces between adjacent pairs of protrusions being dimensioned to receive a part of an interlocking portion of a clip while a part of the forward flange 140 is extending into a gap defined by the interlocking portion of the clip. Each clip 104 comprises a first interlocking portion 106 defining a first gap 108 and a second interlocking portion 116 defining a second gap 118.

Referring to FIGS. 2-8, in embodiments, a first group 180 of port protrusions 176 is arranged on the portward facing surface 148 of the forward flange 140 along the forward edge 162 of the additional slot 172 and a second group 182 of port protrusions 176 is arranged on the portward facing surface 148 of the forward flange 140 along the rearward edge 164 of the additional slot 172. In embodiments, a third group 184 of starboard protrusions 178 is arranged on the starboard facing surface 146 of the forward flange 140 along the forward edge 162 of the additional slot 172 and a fourth group 186 of starboard protrusions 178 is arranged on the starboard facing surface 146 of the forward flange 140 along the rearward edge 164 of the additional slot 172. In embodiments, the protrusions in the first group 180, the second group 182, the third group 184 and the fourth group 186 are equally spaced along the respective edge with spaces between adjacent pairs of protrusions being dimensioned to receive a part of an interlocking portion of a clip while a part of the forward flange 140 is extending into a gap defined by the interlocking portion of the clip 104. Each clip 104 comprises a first interlocking portion 106 defining a first gap 108 and a second interlocking portion 116 defining a second gap 118. In embodiments, each clip 104 has a longest dimension that is greater than 1 inch. In embodiments, each clip 104 has a longest dimension that is greater than 1.5 inches. In embodiments, each clip 104 has a longest dimension that is greater than 2 inches. In embodiments, each clip 104 has a longest dimension that is greater than 2.5 inches. In embodiments, each clip 104 has an overall height that is greater than 1 inch. In embodiments, each clip 104 has an overall height that is greater than 1.5 inches. In embodiments, each clip 104 has an overall height that is greater than 2 inches. In embodiments, each clip 104 has an overall height that is greater than 2.5 inches.

Referring to FIGS. 1A-1D, 3 and 7, an upward direction Z and a downward or lower direction −Z are illustrated using arrows labeled "Z" and "−Z," respectively. A forward direction Y and a rearward direction −Y are illustrated using arrows labeled "Y" and "−Y," respectively. A starboard direction X and a port direction −X are illustrated using arrows labeled "X" and "−X," respectively. The directions illustrated using these arrows are applicable to the apparatus throughout this application. The port direction may also be referred to as the portward direction. In embodiments, the upward direction is generally opposite the downward direction. In embodiments, the upward direction and the downward direction are both generally orthogonal to an XY plane defined by the forward direction and the starboard direction. In embodiments, the forward direction is generally opposite the rearward direction. In embodiments, the forward direction and the rearward direction are both generally orthogonal to a ZY plane defined by the upward direction and the starboard direction. In embodiments, the starboard direction is generally opposite the port direction. In embodiments, starboard direction and the port direction are both generally orthogonal to a ZX plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboard," should not be interpreted to limit the scope of the invention recited in the attached claims.

Figure 11C:
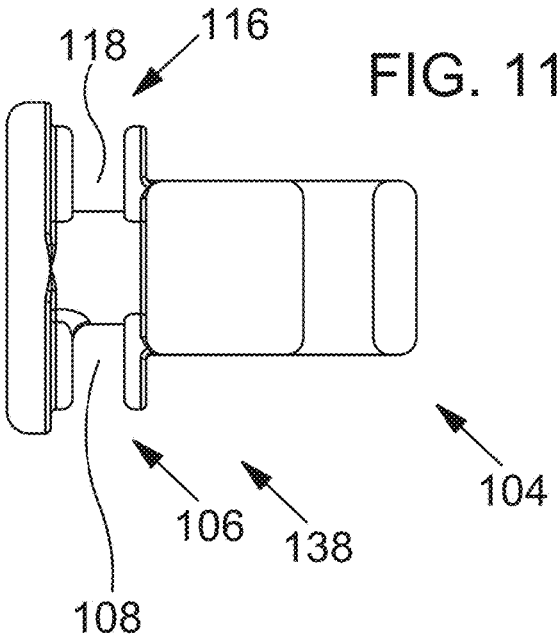
FIG. 11C is a top view of the clip shown in FIG. 11A.
Figure 11A:
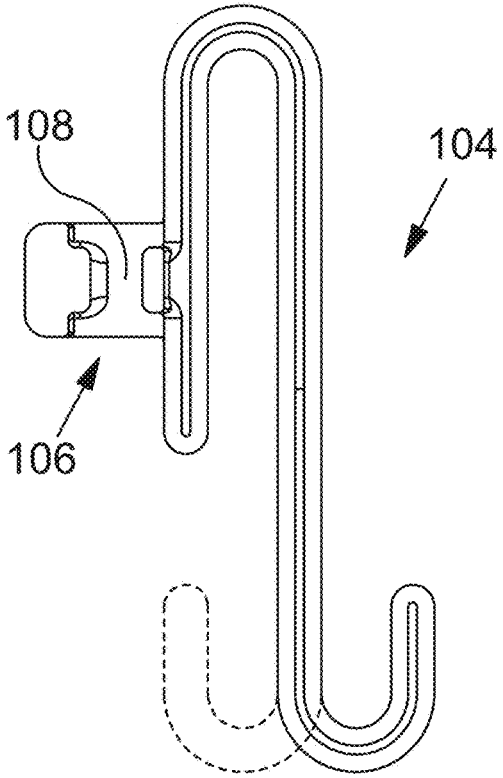
FIG. 11A is a front view of a clip in accordance with the detailed description.
Figure 11B:
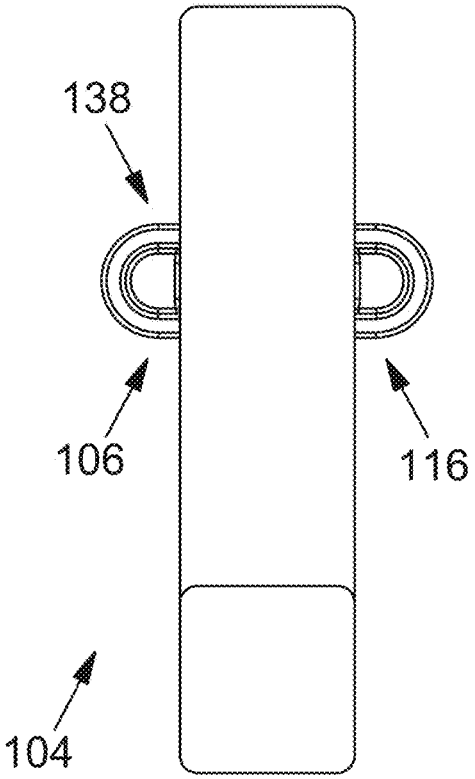
FIG. 11B is a right side view of the clip shown in FIG. 11A.

Referring to FIGS. 11A through 11F, elevation and plan views of a clip 104 are shown. FIGS. 11A through 11F may be collectively referred to as FIG. 11. In the embodiment of FIG. 11, the clip 104 has a shape similar to the shape of a letter S seen in a front view or a rear view. In FIGS. 11A and 11D, an alternate embodiment of a clip is illustrated using dashed lines. The clip illustrated using dashed lines has a shape similar to the shape of a letter C seen in a front view or a rear view.

With reference to FIG. 11A through FIG. 11F, it is noted that engineer graphics textbooks generally refer to the process used to create views showing six sides of a three dimensional object as multiview projection or orthographic projection. It is customary to refer to multiview projections using terms such as front view, right side view, top view, rear view, left side view, and bottom view. In accordance with this convention, FIG. 11A may be referred to as a front view of the clip 104, FIG. 11B may be referred to as a right side view of the clip 104, and FIG. 11C may be referred to as a top view of the clip 104. FIG. 11A through FIG. 11F may be referred to collectively as FIG. 11. Terms such as front view and right side view are used herein as a convenient method for differentiating between the views shown in FIG. 11. It will be appreciated that the elements shown in FIG. 11 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 11D may be referred to as a rear view of the clip 104, FIG. 11E may be referred to as a left side view of the clip 104, and FIG. 11F may be referred to as a bottom view of the clip 104. As shown in FIG. 11, the clip 104 comprises a first interlocking portion 106 defining a first gap 108 and a second interlocking portion 116 defining a second gap 118.

Figures 12A, 12B, 12C:
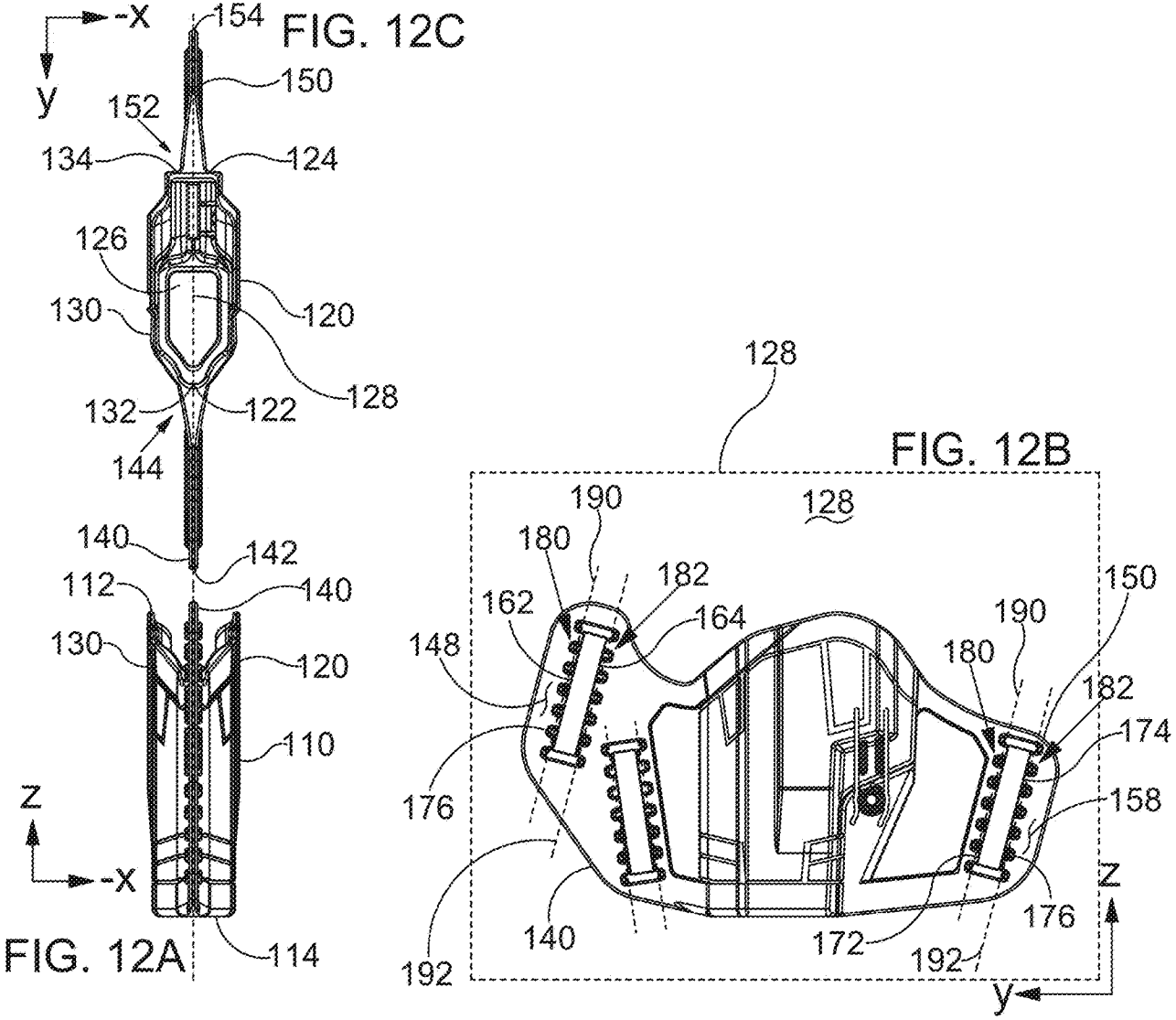
FIG. 12A is a front view of a holster in accordance with the detailed description.
FIG. 12B is a right side view of the holster shown in FIG. 12A.
FIG. 12C is a top view of the holster shown in FIG. 12A.
Figures 12D, 12E, 12F:
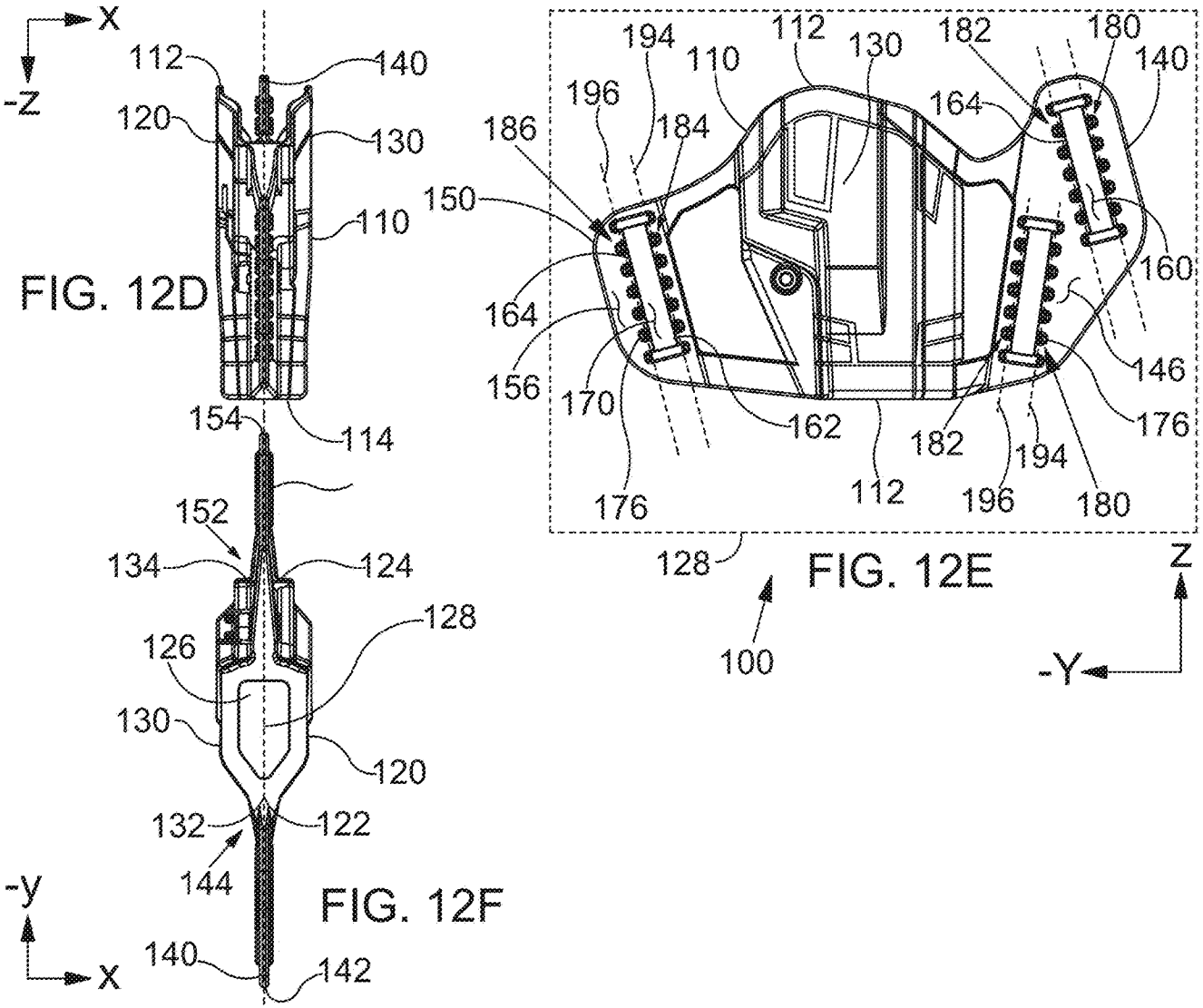
FIG. 12D is a rear view of the holster shown in FIG. 12A.
FIG. 12E is a left side view of the holster shown in FIG. 12A.
FIG. 12F is a bottom view of the holster shown in FIG. 12A.

Referring to FIG. 12A through FIG. 12F elevation and plan views showing six sides of a holster 100 are presented. Engineer graphics textbooks generally refer to the process used to create views showing six sides of a three dimensional object as multiview projection or orthographic projection. It is customary to refer to multiview projections using terms such as front view, right side view, top view, rear view, left side view, and bottom view. In accordance with this convention, FIG. 12A may be referred to as a front view of the holster 100, FIG. 12B may be referred to as a right side view of the holster 100, and FIG. 12C may be referred to as a top view of the holster 100. FIG. 12A through FIG. 12F may be referred to collectively as FIG. 12. Terms such as front view and right side view are used herein as a convenient method for differentiating between the views shown in FIG. 12. It will be appreciated that the elements shown in FIG. 12 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 12D may be referred to as a rear view of the holster 100, FIG. 12E may be referred to as a left side view of the holster 100, and FIG. 12F may be referred to as a bottom view of the holster 100.

Figure 15D:
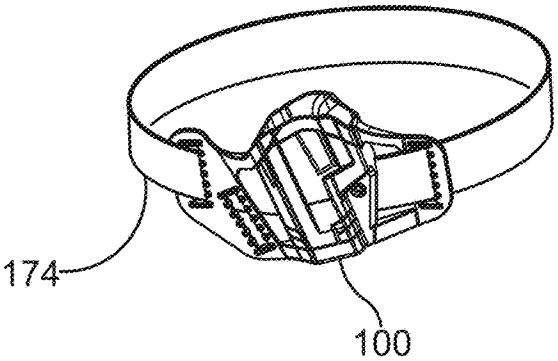
FIGS. 15A through 15D are a group of perspective views showing various wearing configurations of a holster.
Figure 15B:
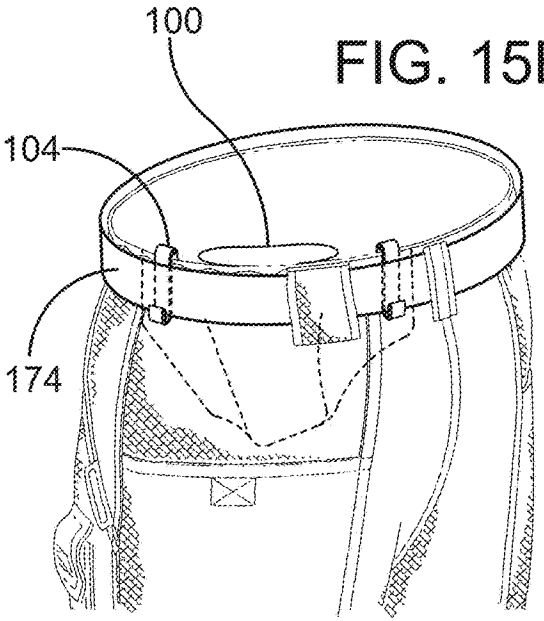
Figure 15C:
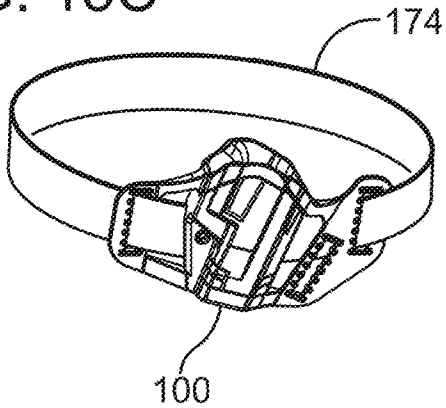
Figure 15A:
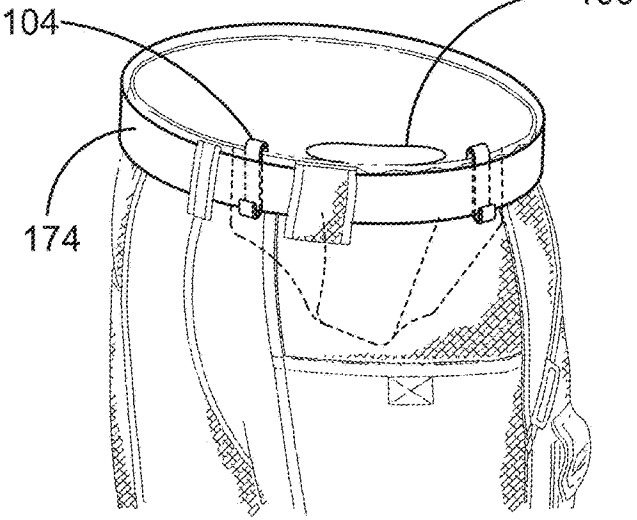

Referring to FIGS. 15A-15D, a group of perspective views showing various wearing configurations of a holster 100 are shown. FIG. 15A is a perspective view showing a holster 100 disposed inside the waistband of a pair of pants. In the example embodiment of FIG. 15A, a belt 174 is positioned to overlay a portion of each clip attached to the holster 100. The belt 174 can be seen resting in a hook portion of each clip in FIG. 15A. In the example embodiment of FIG. 15A, the holster is located proximate a right rear pocket of the pants for convenient use by a right handed user. FIG. 15B is a perspective view showing the holster 100 disposed inside the waistband of a pair of pants. In the example embodiment of FIG. 15B, the holster 100 is located proximate a left rear pocket of the pants for convenient use by a left handed user. In the example embodiment of FIG. 15B, a belt 174 is positioned to overlay a portion of each clip attached to the holster 100. The belt 174 can be seen resting in a hook portion of each clip in FIG. 15B. FIG. 15C is a perspective view showing the holster 100 and a belt 174 extending through slots defined by the holster 100. In the example embodiment of FIG. 15C, the holster 100 may be worn outside the waistband of a pair of pants with the holster 100 located proximate a right rear pocket of the pants for convenient use by a right handed user. FIG. 15D is a perspective view showing the holster 100 and a belt 174 extending through slots defined by the holster 100. In the example embodiment of FIG. 15D, the holster 100 may be worn outside the waistband of a pair of pants with the holster 100 located proximate a left rear pocket of the pants for convenient use by a left handed user.

Figure 16A:
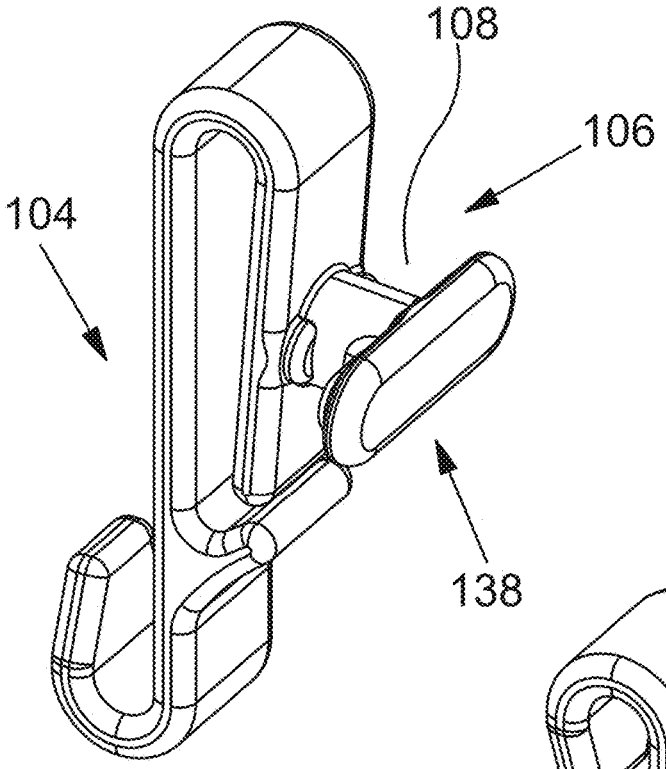
FIG. 16A and FIG. 16B are two perspective views of a clip in accordance with the detailed description.
Figure 16B:
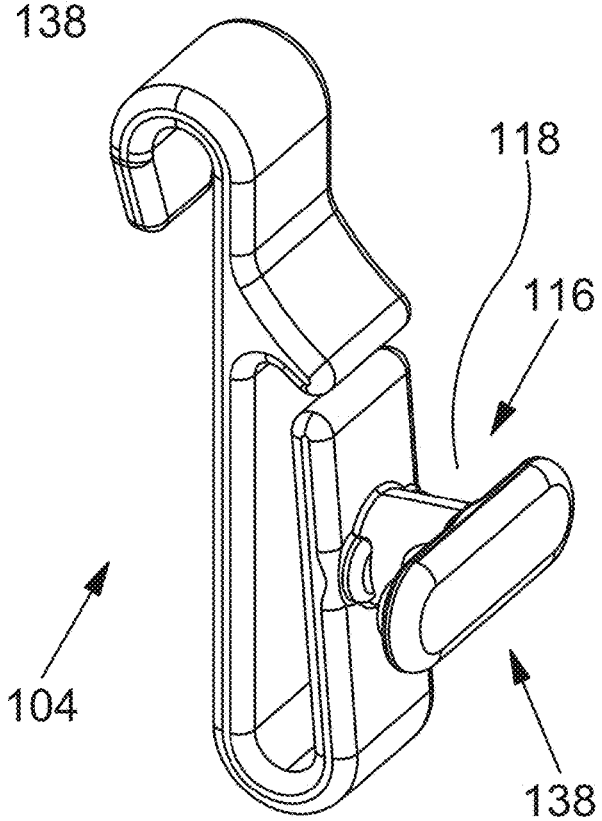

Referring to FIGS. 16A and 6B, two perspective views of a clip 104 in accordance with this detailed description are shown. FIGS. 16A and 16B may be collectively referred to as FIG. 16. The clip 104 of FIG. 16 includes a T-shaped holster body attachment portion that may be inserted into a slot defined by a holster. The clip 104 may then be rotated so that the T-shaped holster body attachment portion secures the clip to the holster at a selected location along the slot. As shown in FIG. 16, the T-shaped holster body attachment portion of the clip 104 comprises a first interlocking portion 106 defining a first gap 108 and a second interlocking portion 116 defining a second gap 118.

Figure 17C:
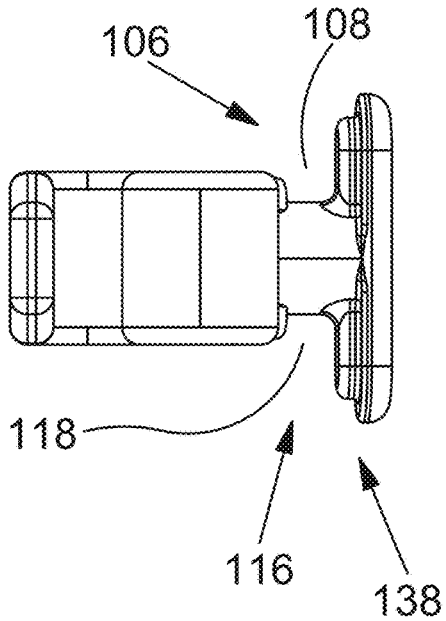
FIG. 17C is a top view of the clip shown in FIG. 17A.
Figure 17A:
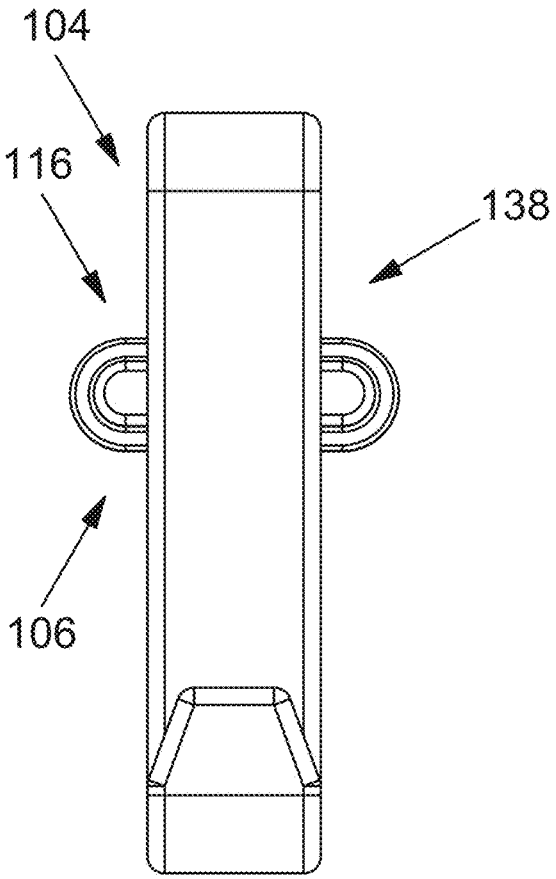
FIG. 17A is a right side view of a clip in accordance with the detailed description.
Figure 17B:
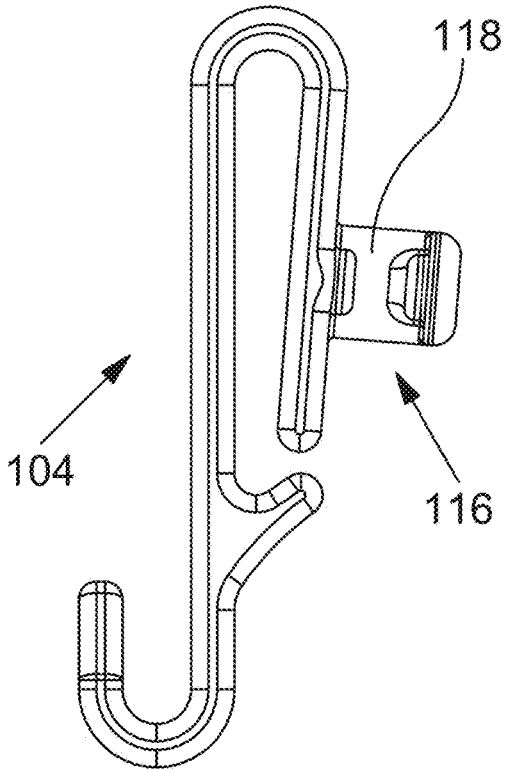
FIG. 17B is a rear view of the clip shown in FIG. 17A.
Figure 17D:
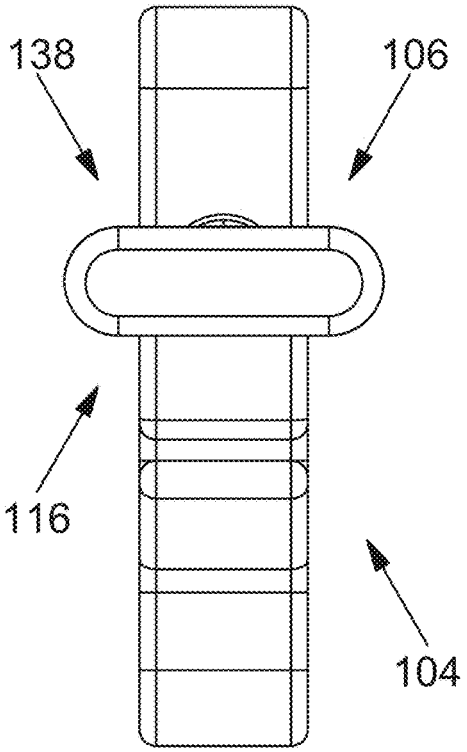
FIG. 17D is a left side view of the clip shown in FIG. 17A.
Figure 17E:
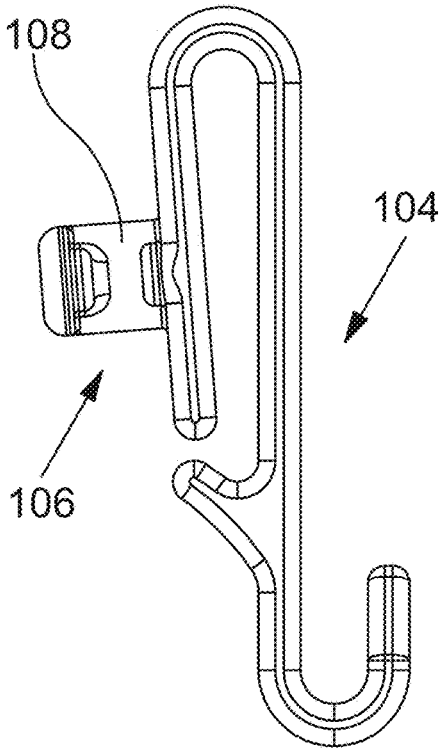
FIG. 17E is a front side view of the clip shown in FIG. 17A.
Figure 17F:
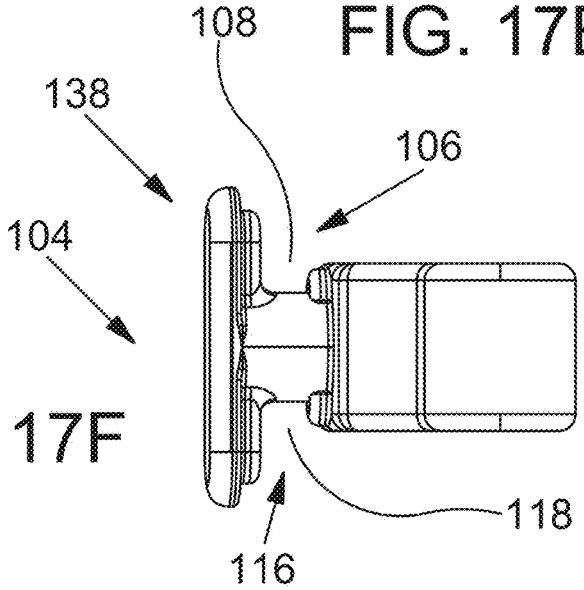
FIG. 17F is a bottom view of the clip shown in FIG. 17A.

FIG. 17A is a right side view of a clip 104 in accordance with this detailed description. FIGS. 17B and 17B are a rear view of the clip shown in FIG. 17A and a top view of the clip shown in FIG. 17A, respectively. FIGS. 17D and 17E are a left side view of the clip shown in FIG. 17A and a front side view of the clip shown in FIG. 17A, respectively. FIG. 17F is a bottom view of the clip shown in FIG. 17A. FIGS. 17A through 17F may be collectively referred to as FIG. 17. As shown in FIG. 17, the clip 104 comprises a first interlocking portion 106 defining a first gap 108 and a second interlocking portion 116 defining a second gap 118.

Referring to FIGS. 3-11 and 17, in embodiments, a holster 100 for wearing inside the waist band and outside the waist band comprises a body portion 110 and a plurality of clips 104. The body portion 110 may include a handgun receiving portion and a unitarily formed forward flange 140 and opposing rearward flange 150. Each of the forward flange 140 and the rearward flange 150 may have a starboard side and a port side with respective starboard facing surfaces and port facing surfaces. In embodiments, each of the forward flange 140 and the rearward flange 150 has a slotted portion. In embodiments, one of the slotted portions defines two slots, and the other of the slotted portions defines one slot. Each of the slots may be sized for receiving a belt. In embodiments, each of the slots has a forward edge 162 and a rearward edge 164. In embodiments, each of the slots has a spaced series of bumps and valleys formed on the starboard surface adjacent the respective forward edge 162 and adjacent the respective rearward edge 164. In embodiments, each of the slots has a spaced series of bumps and valleys formed on the port surface adjacent the respective forward edge 162 and adjacent the respective rearward edge 164. In embodiments, each of the plurality of clips 104 has a hook portion for attachment over a belt and/or waistband. In embodiments, the hook portion has a J-shape or an S-shape. In embodiments, each of the plurality of clips 104 comprises a unitary flange attachment portion. In embodiments, the flange attachment portion of each of the clips 104 has a T-shape with a shank portion defining the lower leg of the T-shape and the upper legs of the T-shape forming a first interlocking portion 106 and a second interlocking portion 116. In embodiments, the shank portion of the T-shape extends away from hook portion and the interlocking portions oriented in an orientation direction cross-wise to an orientation direction of the hook portion. In embodiments, each of the slots are sized to receive the flange attachment portion, and upon receiving the flange attachment portion, each clip is rotatable to align the orientation direction of the hook portion with an orientation of the respective slot, wherein the first interlocking portion 106 is seated between adjacent bumps on one of the spaced series of bumps and valleys and the second interlocking portion 116 is seated between adjacent bumps on another of the spaced series of bumps and valleys.

Referring to FIGS. 3-11 and 17, in embodiments, a holster 100 for wearing inside the waist band and outside the waist band comprises a body portion 110 and a plurality of clips 104. The body portion 110 of the holster 100 may comprise a port shell 120 and a starboard shell 130 that cooperate to define a cavity 126 for receiving and holding the handgun 102. The upper end 112 of the body portion 110 may define an upper opening 136 of the cavity 126. In embodiments, the body portion 110 includes a forward flange 140 having a rearward end 144 abutting the forward ends of the shells. The forward flange 140 may have a starboard facing surface 146 and a portward facing surface 148. In embodiments, the forward flange 140 defines at least one forward slot 160 extending between the starboard facing surface 146 and the portward facing surface 148. In embodiments, the rearward flange 150 has a forward end 152 abutting the rearward ends of the shells. The rearward flange 150 may have a starboard facing surface 156 and a portward facing surface 158. In embodiments, the rearward flange 150 defines at least one rearward slot 170 extending between the starboard facing surface 156 and the portward facing surface 158. In embodiments, the rearward flange 150 has a shape that is substantially a mirror image about the central plane 128. In embodiments, the rearward flange 150 and the forward flange 140 each define a window. In embodiments, each window is positioned to form a flexure or hinge portion of the respective flange. In embodiments, each window is positioned to form a hinge portion of the respective flange. In embodiments, each window is positioned to form a first arm and a second arm, the total cross-sectional area of the arms being less than a cross-sectional area that the respective flange would have without the window. In embodiments, each window is positioned to form a portion of the respective flange having increased flexibility. In embodiments, the forward flange 140 has a shape that is substantially a mirror image about the central plane 128. In embodiments, the holster 100 comprises a plurality of port protrusions 176 and starboard protrusions 178. The port protrusions 176 are disposed on the portward facing surface 148 of the forward flange 140 and the portward facing surface 158 of the rearward flange 150. In embodiments, each port protrusion 176 extends in the portward direction beyond the corresponding portward facing surface, the portward direction being generally orthogonal to the central plane 128. In embodiments, the starboard protrusions 178 are disposed on the starboard facing surface 146 of the forward flange 140 and the starboard facing surface 156 of the rearward flange 150. In embodiments, each starboard protrusion 178 extends in a starboard direction beyond the corresponding starboard facing surface, the starboard direction being generally orthogonal to the central plane 128. In embodiments, the forward flange 140 defines an additional slot 172. In embodiments, each slot has forward edge 162 and a rearward edge 164. In embodiments, each of the plurality of clips 104 comprises a unitary flange attachment portion. In embodiments, the flange attachment portion of each of the clips 104 has a T-shape with a shank portion defining the lower leg of the T-shape and the upper legs of the T-shape forming a first interlocking portion 106 and a second interlocking portion 116. The first interlocking portion 106 of each clip 104 defines a first gap 108 and the second interlocking portion 116 of each clip 104 defines a second gap 118. In embodiments, each of the slots are sized to receive the flange attachment portion. In embodiments, each clip 104 is rotatable so that one of the interlocking portions 106, 116 is seated between two port protrusions 176 and two starboard protrusions 178 adjacent to the forward edge 162 of the respective slot and the other of the interlocking portions 106, 116 is seated between two port protrusions 176 and two starboard protrusions 178 adjacent to the rearward edge 164 of the respective slot.

Figure 13:
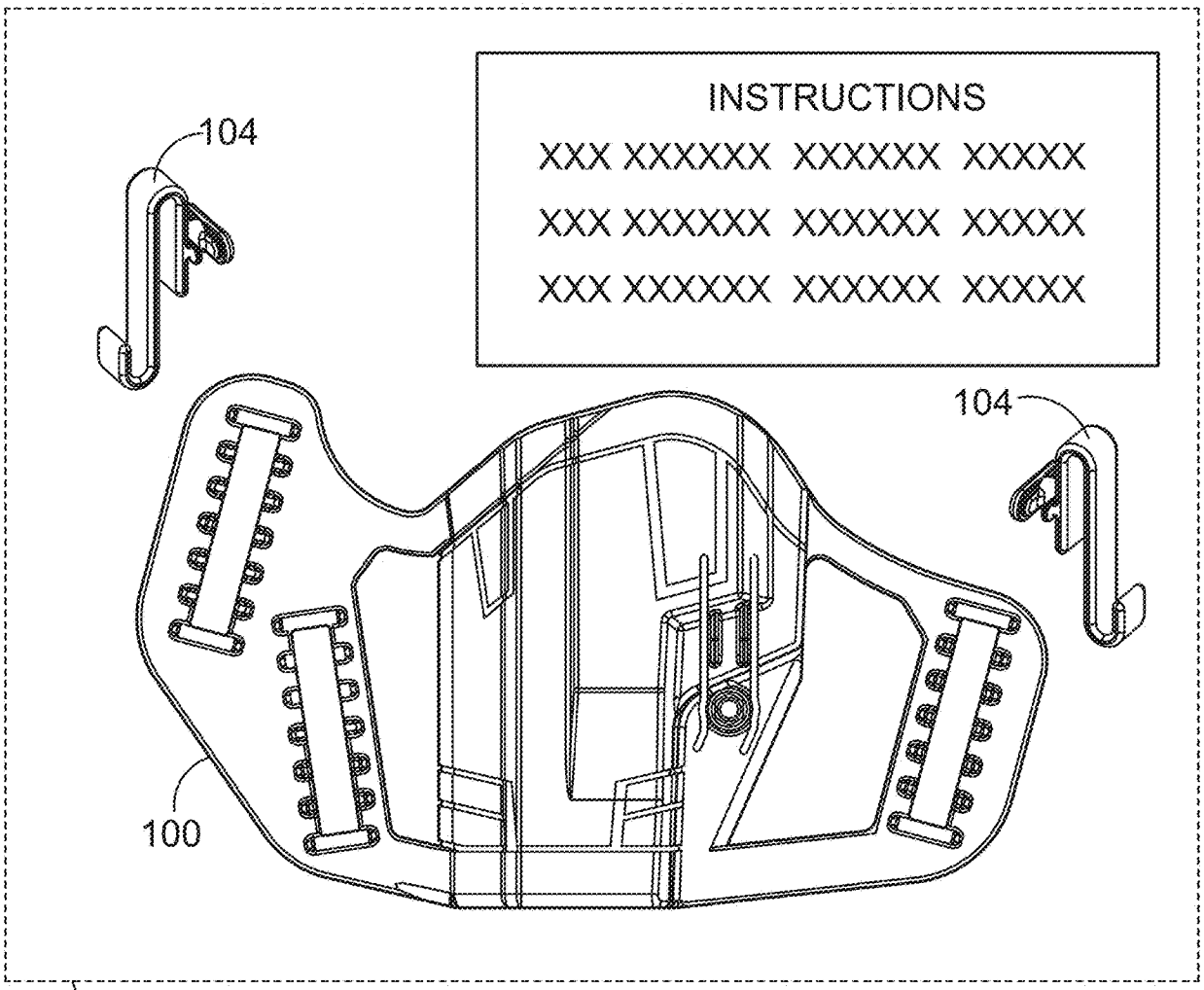
FIG. 13 is a plan view showing a kit including packaging enclosing a plurality of clips with a holster and instructions for attaching the clips to the holster.
Figure 14A:
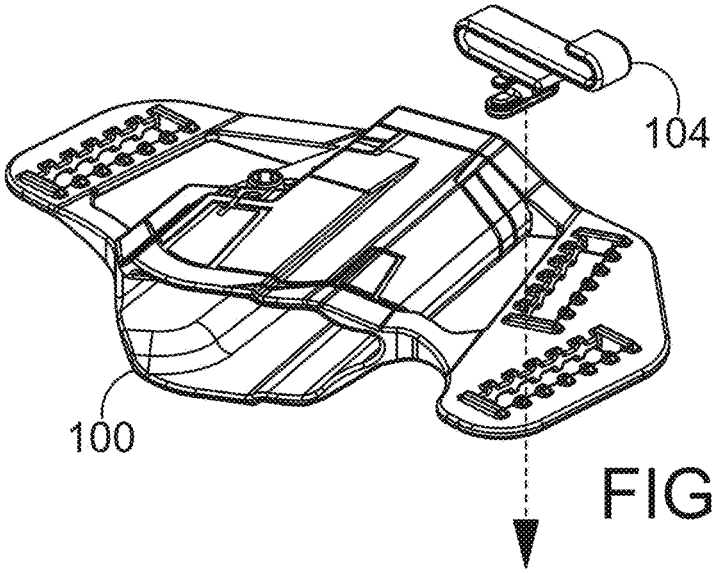
FIGS. 14A through 14C are a sequence of perspective views showing a clip being attached to a holster. A method of attaching a clip to a holster may include inserting the T-shaped holster body attachment portion of the clip into a slot defined by the holster. A method of attaching a clip to a holster may include may also include rotating the clip so that the T-shaped holster body attachment portion secures the clip to the holster at a location along the first slot.
Figure 14B:
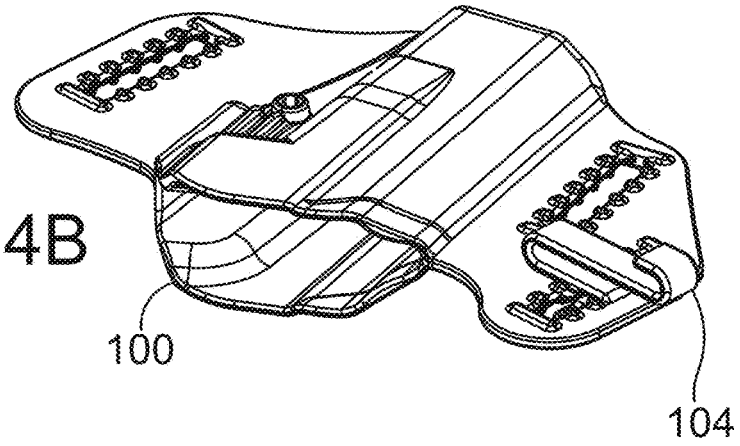
Figure 14C:
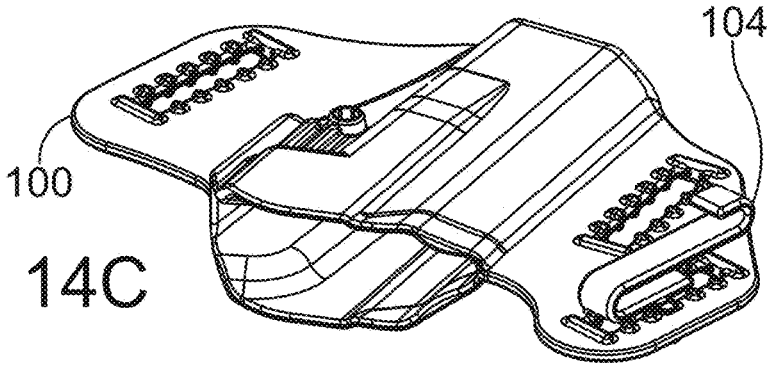

Referring to FIGS. 2-17, in embodiments, a holster kit comprises a holster 100 and a plurality of clips 104, each clip 104 comprising a first interlocking portion 106 defining a first gap 108 and a second interlocking portion 116 defining a second gap 118. The holster 100 may comprise a body portion 110 having a central portion defining a cavity 126 dimensioned to receive a handgun. In embodiments, the body portion 110 comprises a pair of flat ears, the ears including a forward ear 140 extending forward of the cavity 126 and a rearward ear 150 extending rearward of the cavity 126. The forward ear 140 may define a forward slot 160 and the rearward ear 150 may define a rearward slot 170. In embodiments, each slot has a forward edge 162 and a rearward edge 164. In embodiments, each slot is configured and dimensioned to receive a belt and/or one or more of the clips. In embodiments, each ear has changes in thickness adjacent the forward edge 162 and the rearward edge 164 of each slot. In embodiments, the changes in thickness defining multiple discrete positions for receiving a first interlocking portion 106 and a second interlocking portion 116 of each clip 104. Referring to FIG. 13, a kit may further include packaging 200 and instructions explaining use of the holster 100 in OWB and IWB configurations.

Referring to FIGS. 3-17, in embodiments, a method of configuring a holster 100 comprises providing a holster body portion having a handgun receiving portion and a unitarily formed forward flange 140 and an opposing rearward flange 150. The method may include providing a first clip 104 and a second clip 104, each clip 104 having a T-shaped holster body attachment portion 138. The method may include inserting the T-shaped holster body attachment portion 138 of the first clip 104 into a selected one of a plurality of slots defined by the holster body portion. The method may include rotating the first clip 104 so that the T-shaped holster body attachment portion 138 secures the first clip 104 to the holster 100 at a first location along the selected slot. The method may include inserting the T-shaped holster body attachment portion 138 of the second clip 104 into another selected slot of the plurality of slots defined by the holster body portion. The method may include rotating the second clip 104 so that the T-shaped holster body attachment portion 138 secures the other selected clip 104 to the holster 100 at a first place along the other selected slot. The method may further comprise rotating the first clip 104 to unsecure the T-shaped holster body attachment portion 138 from the holster 100, moving the first clip 104 to a second position along the selected slot, and rotating the first clip 104 so that the T-shaped holster body attachment portion 138 secures the first clip 104 to the holster 100 proximate the second position. The method may comprise rotating the second clip 104 to unsecure the T-shaped holster body attachment portion 138 from the holster 100, moving the second clip 104 to a second place along the other selected slot xx, and rotating the second clip 104 so that the T-shaped holster body attachment portion 138 secures the second clip 104 to the holster 100 proximate the second place.

Figure 4:
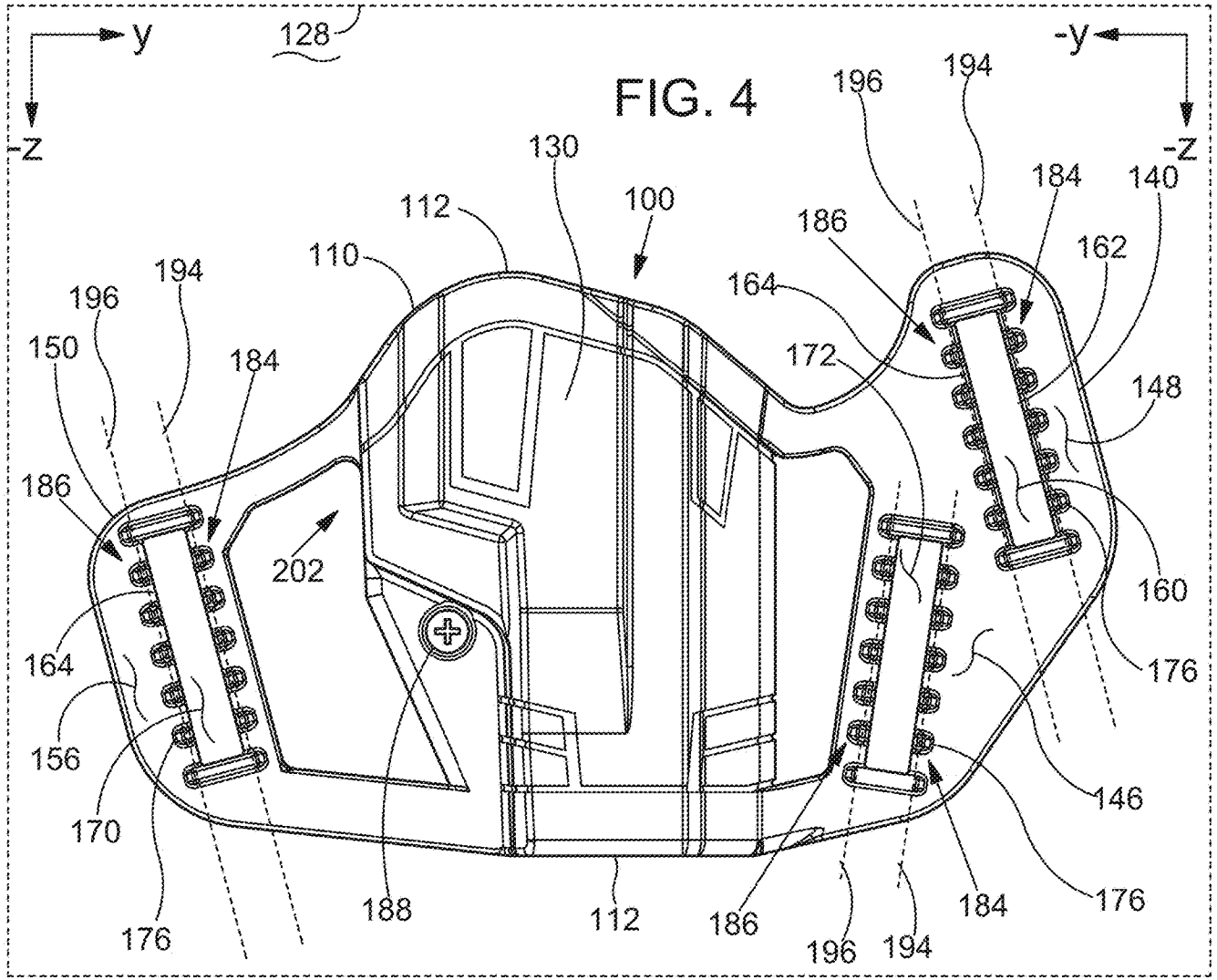
FIG. 4 is a side view of a holster in accordance with the detailed description.
Figure 5:
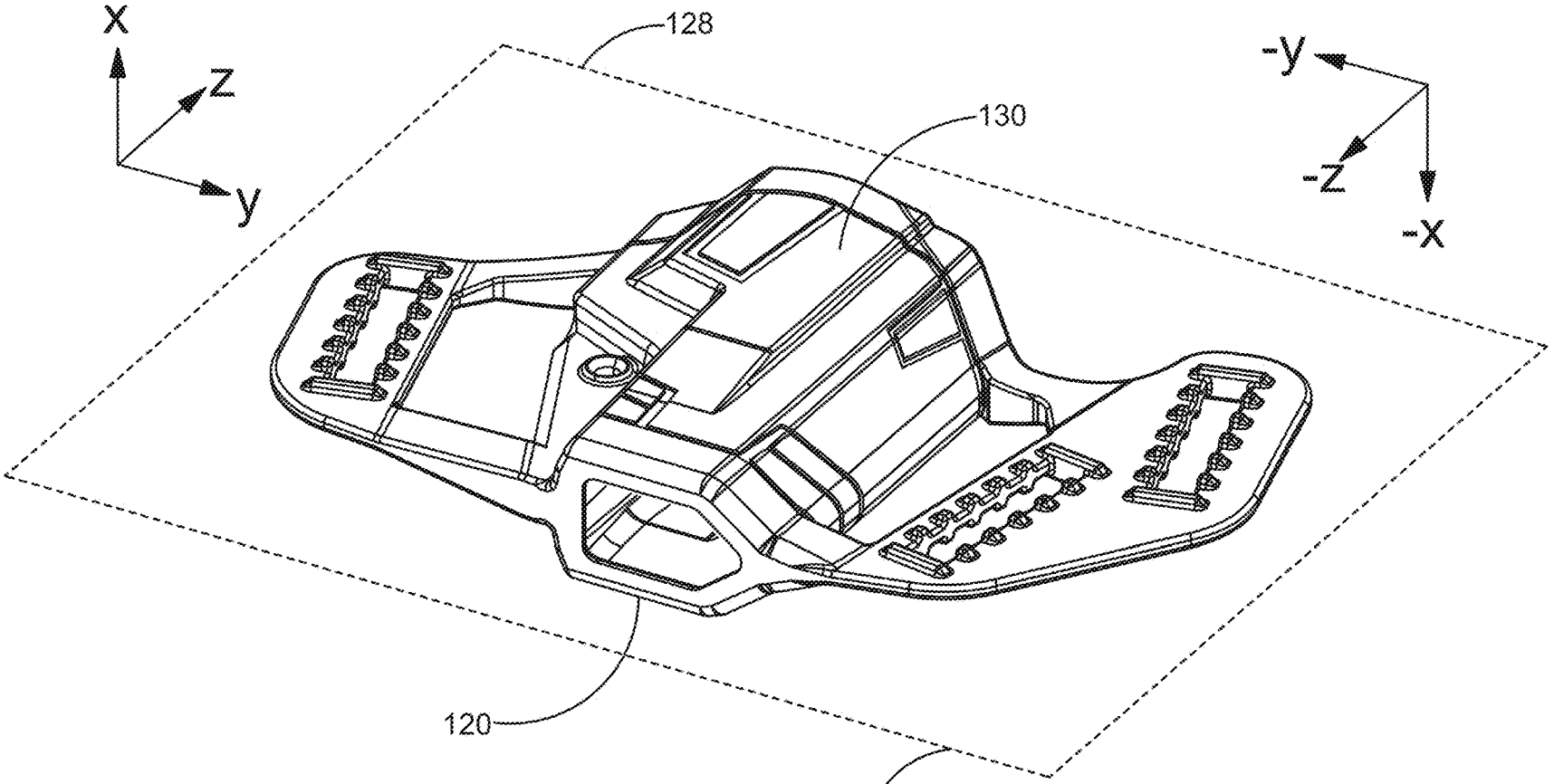
FIG. 5 is a perspective view of a holster in accordance with an embodiment described in the detailed description.
Figure 6:
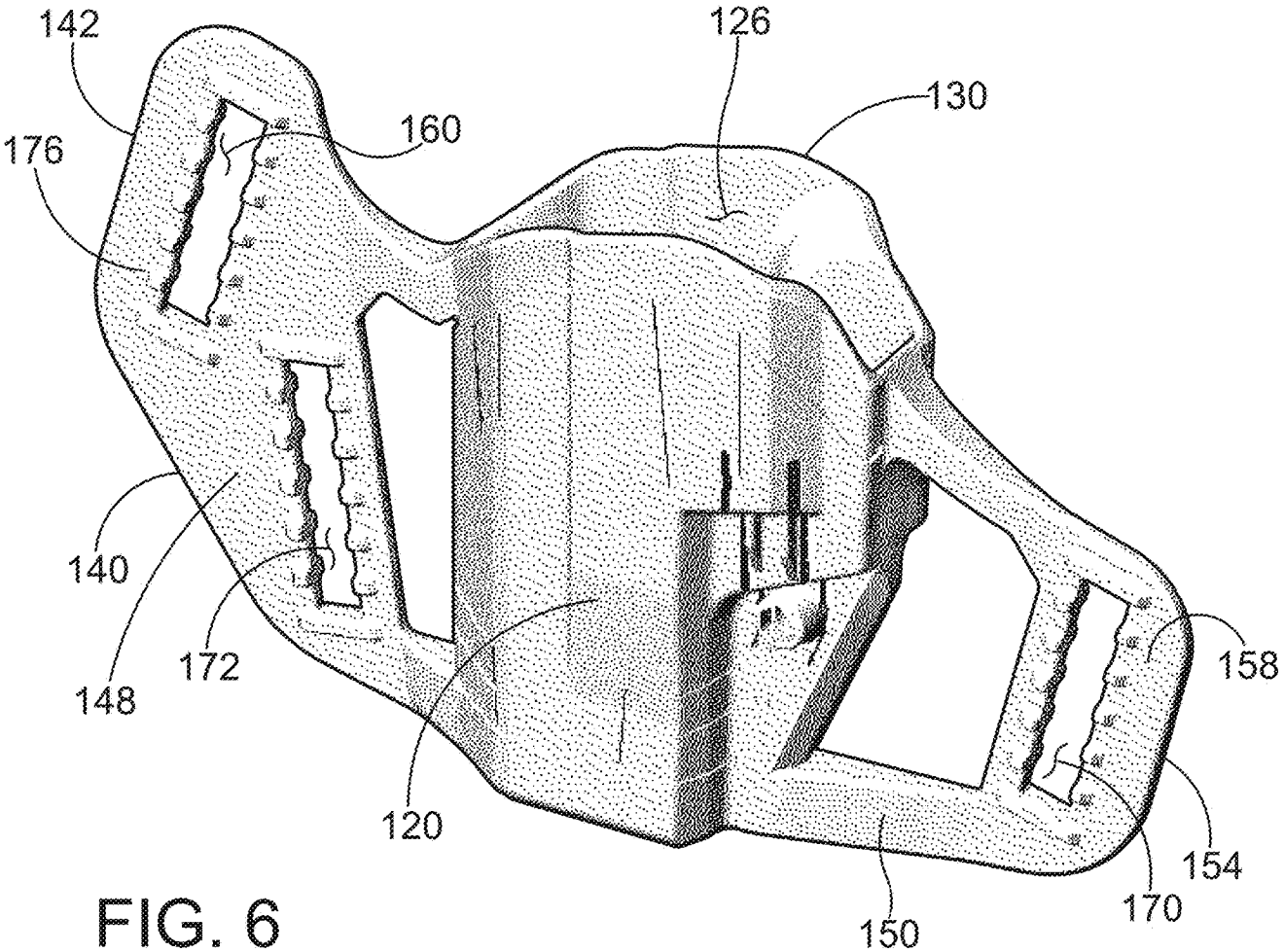
FIG. 6 is a perspective view of a holster in accordance with the detailed description.
Figure 7:
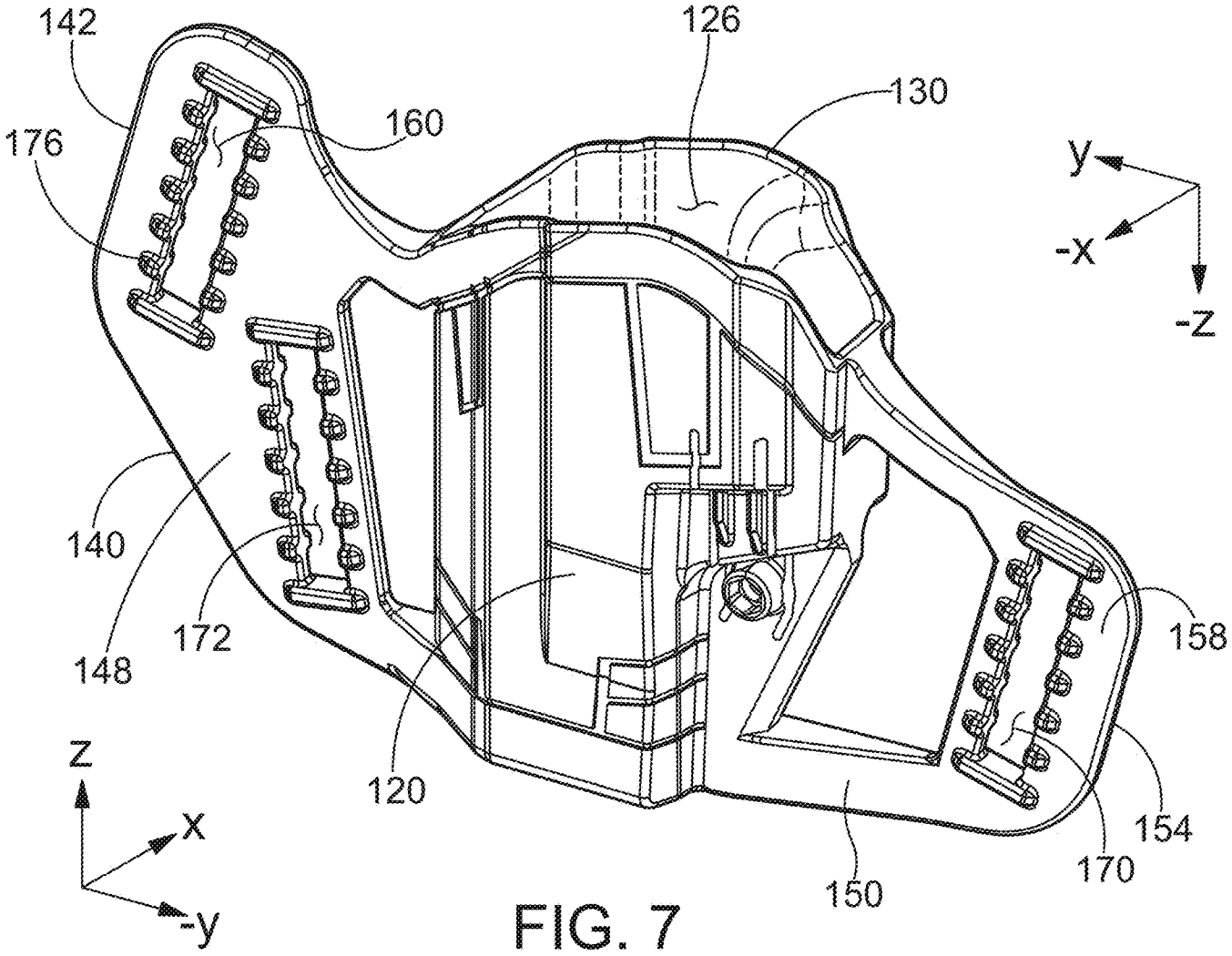
FIG. 7 is a perspective view of a holster in accordance with an embodiment described in the detailed description.
Figure 8:
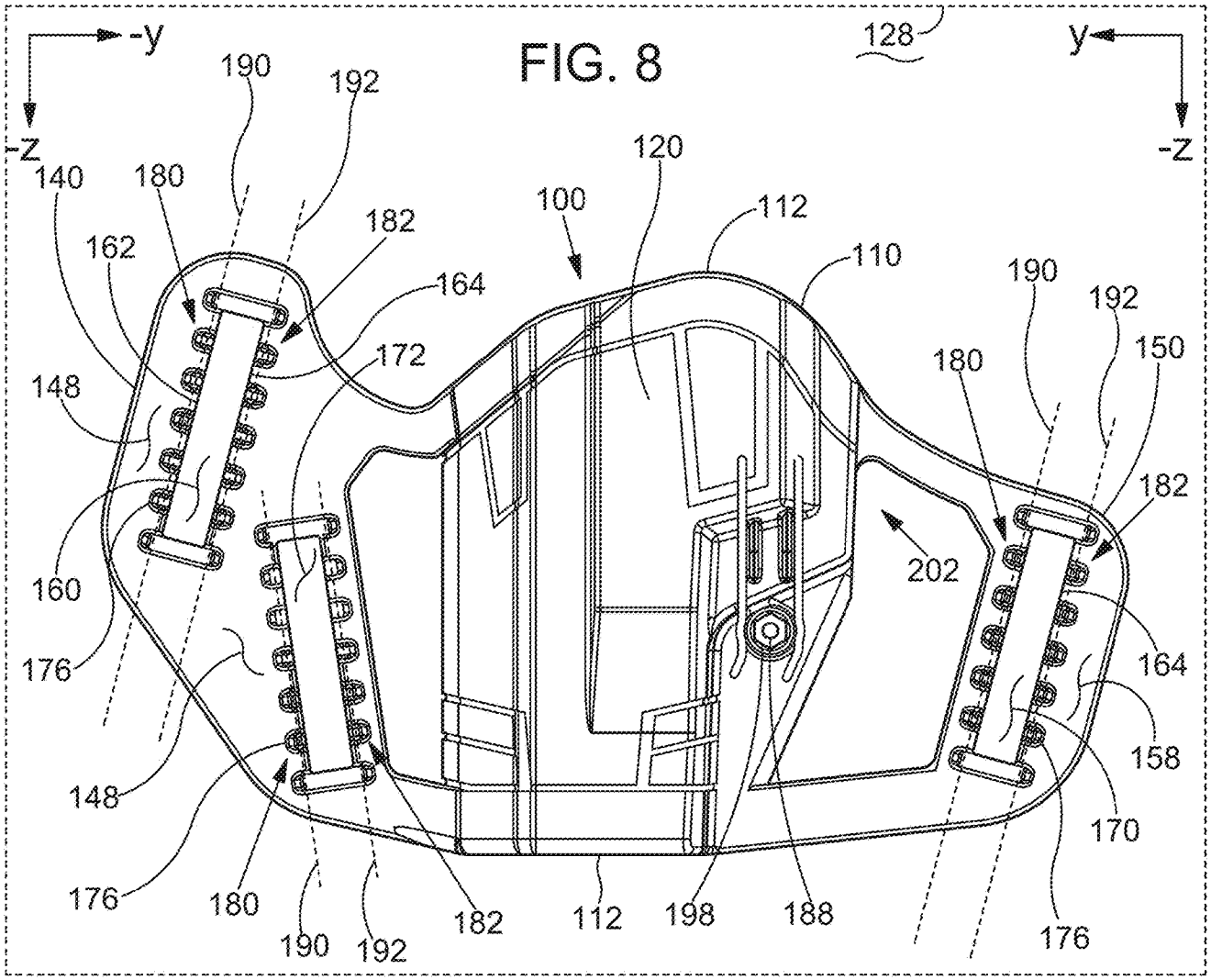
FIG. 8 is a side view of a holster in accordance with the detailed description.
Figure 9:
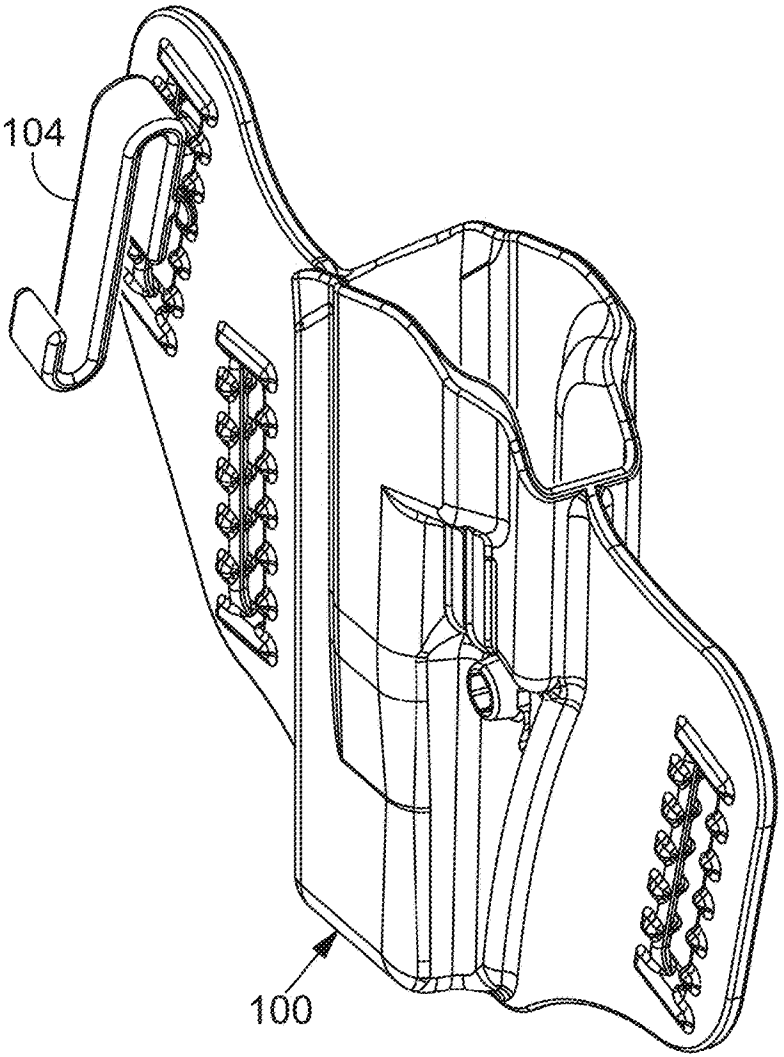
FIG. 9 is a perspective view of an assembly including a holster and a clip.
Figure 10A:
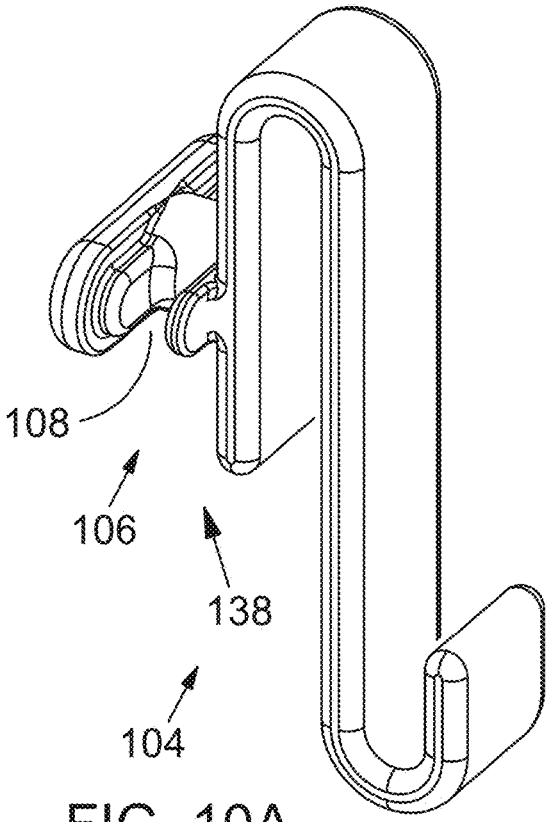
FIG. 10A is a perspective view of a clip in accordance with the detailed description.
Figure 10B:
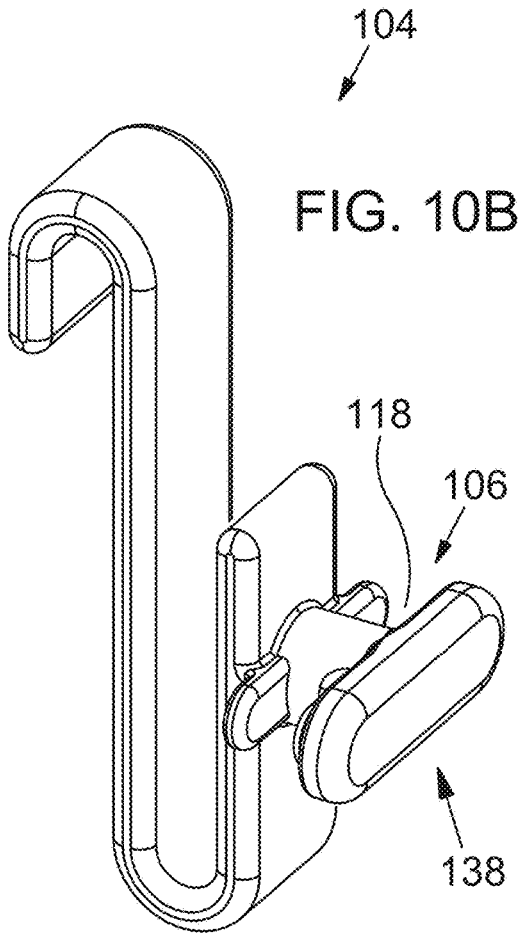
FIG. 10B is a perspective view of a clip in accordance with the detailed description.

Referring to FIGS. 4 and 8, in embodiments, the holster 100 includes a screw thread assembly including a screw 188 and a nut 198. In embodiments, the screw 188 extends through the handgun receiving portion below a trigger guard receiving portion 202 for adjustably controlling the distance between opposing side wall portions of the body portion 110. In embodiments, the screw 188 extends through the port shell 120 and the starboard shell 130 below a trigger guard receiving portion 202 for adjustably controlling the distance between opposing side wall portions of the port shell 120 and the starboard shell 130. In embodiments, one or both of the port shell 120 and the starboard shell 130 define a first slit and a second slit. In embodiments, the screw 188 extends through the port shell 120 and the starboard shell 130 at a location between the first slit and the second slit. In embodiments, the first slit and the second slit define a leaf spring portion of the port shell 120 and/or the starboard shell 130.

The following United States patents are hereby incorporated by reference herein: U.S. Pat. Nos. 3,250,448, 5,865,357, 7,204,395, 7,314,152, 8,672,201, 9,086,254, and 9,144,292. The above references to U.S. patents in all sections of this application are herein incorporated by references in their entirety for all purposes. Components illustrated in such patents may be utilized with embodiments herein. Incorporation by reference is discussed, for example, in MPEP section 2163.07(B).

The above references in all sections of this application are herein incorporated by references in their entirety for all purposes. All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects of embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A holster for wearing inside the waist band and outside the waist band, the holster comprising a body portion and a plurality of clips, the body portion having a handgun receiving portion and a unitarily formed forward flange and opposing rearward flange, each of the forward and rearward flanges having a starboard side and a port side with respective starboard flange surfaces and port flange surfaces;

each of the forward and rearward flanges having a slotted portion, one of the forward and rearward slotted portions having two slots, the other of the forward and rearward slotted portions having one slot, each of the slots sized for receiving a belt, each of the slots having a forward edge and a rearward edge, each of the slots having a spaced series of bumps and valleys formed on the starboard surface adjacent the forward edge and adjacent the rearward edge, each of the slots having a spaced series of bumps and valleys formed on the port surface adjacent the forward edge and adjacent the rearward edge;

each of the plurality of clips having a hook portion for attachment over a belt or waistband, and a unitary flange attachment portion, the hook portion having a J or S shape, the flange attachment portion having a T-shape with a shank portion defining the lower leg of the T-shape and a locking portion defining the upper legs of the T-shape, the shank portion extending away from hook portion and the locking portion oriented in an orientation direction cross-wise to an orientation direction of the hook portion, wherein each of the slots are sized to receive the flange attachment portion, and wherein upon receiving the flange attachment portion, the clip is rotatable to align the orientation direction of the hook portion with an orientation of the respective slot, and wherein the locking portion is seated between adjacent bumps on one of the spaced series of bumps and valleys.

2. The holster of claim 1 wherein each of the flanges defines a window, each window being positioned between the handgun receiving portion and the respective slot or slots, each window providing a hinge portion of the respective flange.

3. The holster of claim 1 wherein the handgun receiving portion has a forward wall portion and a rearward wall portion, each of the forward flange and the rearward flange being centrally positioned on the forward wall portion and the rearward wall portion, respectively.

4. The holster of claim 1 wherein each slot is at least 1 and ¾ inches long.

5. The holster of claim 1 wherein each side of each flange is a mirror image of a respective opposite side.

6. The holster of claim 1 wherein the holster body and flanges are unitarily molded of a thermoplastic polymeric material.

7. The holster of claim 1 wherein at least two of the three slots are oriented in a parallel direction.

8. The holster of claim 1 wherein a threaded fastener extends through the handgun receiving portion below a trigger guard receiving portion for adjustably controlling the distance between opposing side wall portions.

9. The holster of claim 1 wherein the handgun receiving portion and the two flange portions are unitarily molded of a material having a shore D durometer in the range between about 51 and about 69.

10. The holster of claim 1 further comprising packaging and instructions explaining use of the holster in OWB and IWB configurations.

11. A holster for a handgun, the holster capable of mechanically interlocking with one or more clips for receiving a belt and/or a waist band, each clip comprising a first interlocking portion defining a first gap and a second interlocking portion defining a second gap, each clip being rotatable to a locked position without the use of tools while the first interlocking portion and the second interlocking port are received in on of a plurality of holster slots, the holster comprising:

a body portion having an upper end and a lower end, the body portion comprising a port shell and a starboard shell that cooperate to define a cavity for receiving and holding the handgun, the upper end of the body defining an upper opening of the cavity, the cavity extending in a downward direction from the upper opening to the lower end of the body portion;

a forward end of the port shell meeting a forward end of the starboard shell at a central plane, a rearward end of the port shell meeting a rearward end of the starboard shell at the central plane, the cavity having a shape that is substantially a mirror image about the central plane so that the holster can be used by both left-handed users and right-handed users, the central plane extending in a forward direction from the rearward end of the port shell to the forward end of the port shell and extending in a rearward direction from the forward end of the port shell to the rearward end of the port shell, the central plane extending in the upward and downward directions;

a forward flange having a rearward end abutting the forward ends of the shells, the forward flange extending in the forward direction beyond the forward ends of the shells, the forward flange having a starboard facing surface and a portward facing surface, the forward flange defining at least one forward slot extending between the starboard facing surface and the portward facing surface;

a rearward flange having a forward end abutting the rearward ends of the shells, the rearward flange extending in the rearward direction beyond the rearward ends of the shells, the rearward flange having a starboard facing surface and a portward facing surface, the rearward flange defining at least one rearward slot extending between the starboard facing surface and the portward facing surface;

a plurality of port protrusions disposed on the portward facing surface of each flange, each port protrusion extending in a portward direction beyond each corresponding portward facing surface, the portward direction being generally orthogonal to the central plane;

a plurality of starboard protrusions disposed on the starboard facing surface of each flange, each starboard protrusion extending in a starboard direction beyond each starboard facing surface, the starboard direction being generally orthogonal to the central plane;

the forward slot and the rearward slot each having a forward edge and a rearward edge;

a first group of port protrusions arranged on the portward facing surface of the forward flange along the forward edge of each slot;

a second group of port protrusions arranged on the portward facing surface of the forward flange along the rearward edge of each slot;

a third group of starboard protrusions arranged on the starboard facing surface of the forward flange along the forward edge of each slot;

a fourth group of starboard protrusions arranged on the starboard facing surface of the forward flange along the rearward edge of each slot;

the protrusions in the first group, the second group, the third group and the fourth group being equally spaced along the respective edges with spaces between adjacent pairs of protrusions being dimensioned to receive a part of an interlocking portion of a clip while a part of the respective flange is extending into a gap defined by the interlocking portion of the clip.

12. The holster of claim 11 wherein each flange has a shape that is substantially a mirror image about the central plane.

13. The holster of claim 11 wherein the body portion has a shape that is substantially a mirror image about the central plane.

14. The holster of claim 11 wherein the cavity has a shape that is substantially a mirror image about the central plane.

15. The holster of claim 11, wherein:

the port protrusions in the first group extend along a first line;

the port protrusions in the second group extend along a second line; and the second line is generally parallel to the first line;

the starboard protrusions in the third group extend along a third line;

the starboard protrusions in the fourth group extend along a fourth line;

the fourth line is generally parallel to the third line.

16. The holster of claim 11 wherein a threaded fastener extends through the handgun receiving portion below a trigger guard receiving portion for adjustably controlling the distance between opposing side wall portions.

17. The holster of claim 11 wherein the holster body, the forward flange and the rearward flange comprise a thermoplastic elastomeric material having a shore D durometer in the range between about 51 and about 69.

18. A method of configuring a holster comprising:

providing a holster body portion having a handgun receiving portion and a unitarily formed forward flange and opposing rearward flange, each of the forward and rearward flanges having a starboard side and a port side with respective starboard flange surfaces and port flange surfaces, each of the forward and rearward flanges defining one or more plurality of slots, each of the slots sized for receiving a belt, each of the slots having a forward edge and a rearward edge, each of the slots having a spaced series of bumps and valleys formed on the starboard surface adjacent the forward edge and adjacent the rearward edge, each of the slots having a spaced series of bumps and valleys formed on the port surface adjacent the forward edge and adjacent the rearward edge;

providing a first clip and a second clip, each clip having a T-shaped holster body attachment portion;

inserting the T-shaped holster body attachment portion of the first clip into a first slot defined by the holster body portion;

rotating the first clip so that the T-shaped holster body attachment portion secures the first clip to the holster at a first location along the first slot;

inserting the T-shaped holster body attachment portion of the second clip into a second slot defined by the holster body portion; and rotating the second clip so that the T-shaped holster body attachment portion secures the second clip to the holster at a first place along the second slot.

19. The method of claim 1, further comprising:

rotating the first clip to unsecure the T-shaped holster body attachment portion from the holster;

moving the first clip to a second position along the first slot; and rotating the first clip so that the T-shaped holster body attachment portion secures the first clip to the holster proximate the second position.

20. The method of claim 1, further comprising:

rotating the second clip to unsecure the T-shaped holster body attachment portion from the holster;

moving the second clip to a second place along the second slot; and rotating the second clip so that the T-shaped holster body attachment portion secures the second clip to the holster proximate the second place.

* * * * *